United States Patent [19]

Ito et al.

[11] Patent Number: 4,814,824

[45] Date of Patent: Mar. 21, 1989

[54] IMAGE DUPLICATING APPARATUS

[75] Inventors: Masazumi Ito; Kadotaro Nishimori; Kimihiko Higashio, all of Osaka, Japan

[73] Assignee: Minolta Camera Kabushiki Kaisha, Osaka, Japan

[21] Appl. No.: 149,600

[22] Filed: Jan. 28, 1988

[30] Foreign Application Priority Data

Jan. 28, 1987 [JP] Japan ..... 62-18849
Jan. 28, 1987 [JP] Japan ..... 62-18850
Jan. 28, 1987 [JP] Japan ..... 62-18851
Jan. 28, 1987 [JP] Japan ..... 62-18852

[51] Int. Cl.[4] ..... G03G 15/00; G03G 15/01

[52] U.S. Cl. ..... 355/14 R; 355/4; 355/55

[58] Field of Search ..... 355/14 R, 55, 56, 3 R, 355/4; 340/718

[56] References Cited

U.S. PATENT DOCUMENTS 3,914,043 10/1975 McVeigh ..... 355/4
4,054,380 10/1977 Donohue et al. ..... 355/14 R
4,327,994 5/1982 Barley et al. ..... 355/14 R
4,437,756 3/1984 Kawakubo et al. ..... 355/14 R
4,609,283 9/1986 Murata et al. ..... 355/14 R
4,647,188 3/1987 Koyima et al. ..... 355/14 R
4,657,376 4/1987 Ide ..... 355/14 R
4,669,858 6/1987 Ito et al. ..... 355/55 X
4,697,917 10/1987 Takano et al. ..... 355/56 X
4,754,303 6/1988 Ito ..... 355/14 R

*Primary Examiner*—R. L. Moses
*Attorney, Agent, or Firm*—Burns, Doane, Swecker & Mathis

[57] ABSTRACT

A multiple-mode image duplicating apparatus having a plurality of groups of modes of operation, comprising image reproducing means, first selecting means for selecting a single group of modes out of the plurality of groups of modes of operation, second selecting means for selecting a single mode of operation from the group of modes selected by the first selecting means, and control means for controlling the image reproducing means to operate for the mode of operation specified by the first and second selecting means.

50 Claims, 18 Drawing Sheets

IMAGE DUPLICATING APPARATUS

FIELD OF THE INVENTION

The present invention relates to an image duplicating apparatus and particularly to an electrophotographic image duplicating apparatus such as a copying apparatus of the type having an interactive control panel or an interactive section in a control panel.

BACKGROUND OF THE INVENTION

Recent versions of copying apparatus have various extra capabilities including those for binding margins, zoomed magnification and reduction, mathematic calculation and frame erasure. For each of such extra capabilities, there are different requirements such as the widths to be selected for binding margins so as to meet the growing demands from the users. The provision of such additional capabilities and to meet such different requirements, however, the duplicating apparatus necessitates an increased number of switches and controls which lead to added complexity of the control panel through which the operator manually controls the apparatus. The increase in the number of switches and controls further results in the complexity of hardware and requires a microprocessor with an increased capacity and an increased number of input and output ports. All these add to the production cost of duplicating machines being developed.

SUMMARY OF THE INVENTION

The present invention contemplates provision of an image duplicating apparatus which features a control panel having simple construction and a relatively small number of switches and controls as compared to the wide variety of capabilities which can be achieved of the apparatus.

In accordance with the present invention, there is provided a multiple-mode image duplicating apparatus having a plurality of groups of modes of operation, comprising (a) image reproducing means, (b) first selecting means for selecting a single group of modes out of the plurality of groups of modes of operation, (c) second selecting means for selecting a single mode of operation from the group of modes selected by the first selecting means, and (d) control means for controlling the image reproducing means to operate for the mode of operation specified by the first and second selecting means.

BRIEF DESCRIPTION OF THE DRAWINGS

The features and advantages of an image duplicating apparatus according to the present invention will be more clearly appreciated from the following description taken in conjunction with the accompanying drawings in which.

DESCRIPTION OF THE PREFERRED EMBODIMENT

Figure 1:
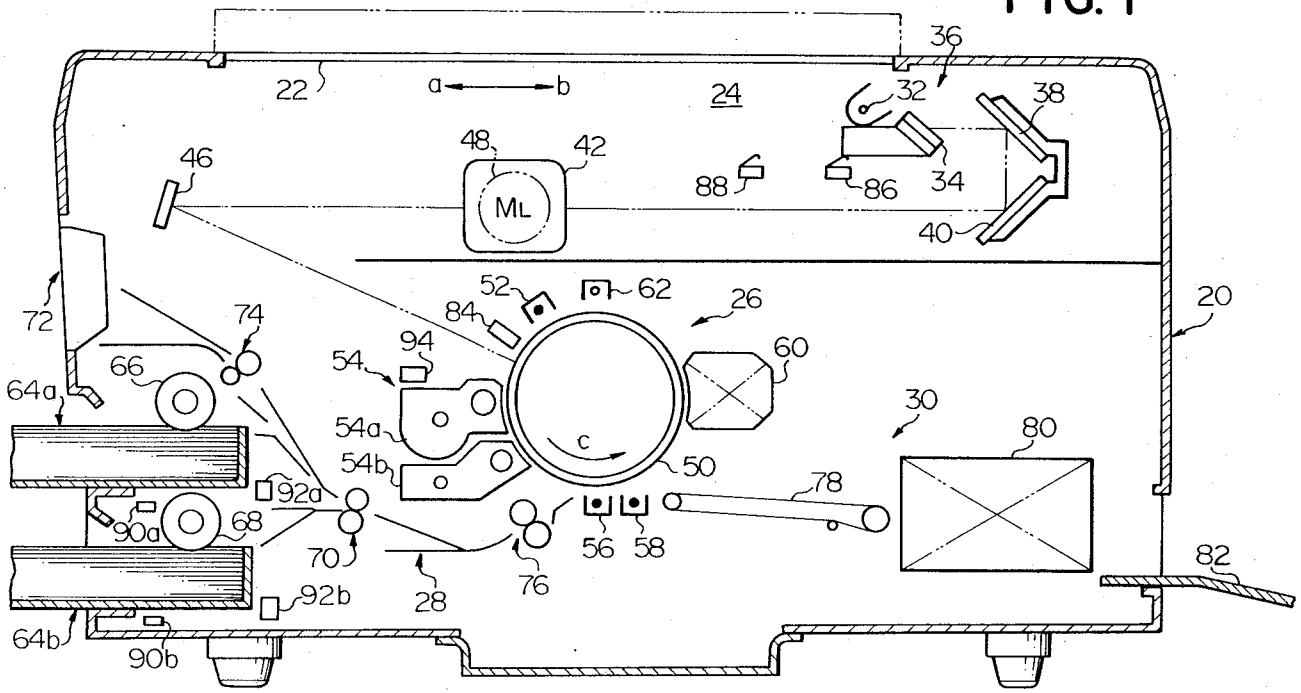
FIG. 1 is a side elevation view showing the general mechanical construction and arrangement of a preferred embodiment of an image duplicating apparatus according to the present invention.

As shown in FIG. 1, an image duplicating apparatus (hereinafter referred to simply as copying apparatus) embodying the present invention comprises a housing 20 having an upper panel portion formed in part by a transparent document table 22. A sheet of document (not shown) bearing images to be reproduced is to be placed on this document table 22.

During duplication operation of the apparatus, the document sheet placed on the document table 22 is optically scanned by illumination with light from an optical scanning system 24. A resultant beam of light carrying information representative of the images on the scanned document sheet is directed to an image reproduction system 26. The images carried by the light beam are thus provisionally recorded in the form of latent images, which are then developed into visible toner images through an electrophotographic process performed by the image reproduction system 26. The visible toner images are transferred to any record medium such as typically a copying sheet transported by a copy sheet feed mechanism 28 and the copy sheet now carrying the reproduced images is withdrawn out of the apparatus by means of an image-fixing and sheet discharge system 30.

The optical scanning system 24 is of the slit exposure type and comprises an exposure lamp 32 from which a beam of light is incident on and reflected from the lower face of the document sheet on the table 22. The light reflected from the document sheet is incident onto an object mirror 34 and is redirected rearwardly therefrom. The lamp 32 and object mirror 34 are carried on a common movable support member and, in combination, implement a document scanner 36 in the image duplicating apparatus embodying the present invention. The document scanner 36 is movable forwardly along the document table 22 as indicated by arrow a and backwardly as indicated by arrow b and has a predetermined home position with respect to the document table 22. The light reflected from the object mirror 34 is redirected toward a mirror 38, which further re-directs the light downwardly toward another mirror 40. The mirrors 38 and 40 are also carried on a common movable support member and are movable together along the document table 22 into and out of predetermined home positions with respect to the table. The document scanner 36 and such a mirror pair 38/40 are operatively coupled to common drive means comprising a scanner drive motor ($M_S$) implemented by a d.c. reversible motor so that the former is driven to travel at a speed doubling the speed of movement of the latter.

From the mirror 4, the light travels forwardly along the document table 22 and passes through an image magnification/reduction lens unit 42 to a projecting mirror 46. The lens unit 42 is movable along the document table 22 independently of the document scanner 36 and mirror pair 38/40 with respect to the table 22. The lens unit 42 is thus operatively coupled to drive means comprising a lens drive motor 48 ($M_L$) which may be implemented by a d.c. stepper motor. From the projecting mirror 46, light is reflected toward the image reproducing system 26. The projecting mirror 46 is herein assumed to be fixedly held with respect to the housing 20 but, where desired, may be arranged to be movable and/or rockable with respect to the housing 20.

The image reproducing system 26 of the apparatus comprises a cylindrical image transfer drum 50 having a photoconductive peripheral surface. The light reflected downwardly from the projecting mirror 52 is projected onto the peripheral surface of this image transfer drum 50. The drum 50 is rotatable about its center axis in a direction indicated by arrow c and is driven for rotation at a fixed peripheral speed by means of a main drive motor (not shown) of the apparatus which may be provided independently of the scanner and lens drive motors. Movement of the lens unit 42 in either direction with respect to the mirror 46 results in a change in the position of the unit 42 with respect to the peripheral surface of the drum 50 and accordingly in a change in the magnification/reduction ratio (hereinafter referred to simply as magnification ratio) of the images to be reproduced. The image reproducing system 26 further comprises a main charger 52 to sensitize the photoconductive peripheral surface of the image transfer drum 50. Posterior to the path of light from the mirror 52 to the drum 50 is located an image developing stage 54 which is herein shown as including two, upper and lower developing units **54*a* and 54*b* detachably mounted in the apparatus and each having a stock of a developer powder composed of a mixture of electrostatically charged carrier particles and black or otherwise colored toner particles. In the description to follow, it will be assumed by way of example that red-colored toner particles is stored in the upper developing unit 54*a* and black-colored toner particles stored in the lower developing unit 54*b***.

In the image developing stage 54 is further provided a drive motor ($M_D$) by means of which the rotatable members forming part of each of the developing units **54*a* and 54*b* are to be driven for rotation for applying toner particles to the peripheral surface of the image transfer drum 50 from a selected one of the developing units 54*a* and 54*b*, as will be described in more detail. Posterior to the developing stage 54 in turn is provided an image transfer charger 56 which is operative to charge the copy sheet so that the toner images formed on the drum 50 are transferred to the copy sheet. The copy sheet thus having the toner images carried thereon is cleared of charges by a separation charger 58 which is located posterior to the transfer charger 56. There is further provided a drum cleaner unit 60 which removes any residual toner particles from the peripheral surface of the drum 50. Posterior to this cleaner unit 60 in turn is located a charge eraser lamp 62 which irradiates the cleaned peripheral surface of the drum 50** to eliminate the charges which may be left thereon.

The copy-sheet feed mechanism 28 of the copying apparatus is provided in conjunction with first and second copy-sheet supply cassettes **64*a* and 64*b* detachably fitted to the housing 20 and which respectively have encased therein stocks of copy sheets of different sizes. The copy-sheet feed mechanism 28 per se comprises first and second copy-sheet feed rollers 66 and 68 associated with the cassettes 64*a* and 64*b*, respectively. Each of these rollers 66 and 68 is driven for rotation for picking up copying sheets one after another from the stack of copy sheets in the associated one of the cassettes 64*a* and 64*b*. A copying sheet picked up from the first copy-sheet supply cassette 64*a* by means of the first copy-sheet feed roller 66 or from the second copy-sheet supply cassette 64*b* by means of the second copy-sheet feed roller 68 is passed through a pair of guide rollers 70 toward the image transfer drum 50. There may be further provided a manual copy-sheet feed slot 72 in the housing 20 so that a copying sheet may be manually inserted into the housing 20 through this slot 72 and transported toward the drum 50 through a pair of guide rollers 74 and by way of the guide rollers 70**.

Immediately posterior to the developing stage 54 is provided a pair of timing rollers 76. A copying sheet which has been transported toward the image transfer drum 50 through the second guide rollers 78 or through the second guide rollers 80 is brought into contact with the peripheral surface of the drum 50 past these timing rollers 76. The timing rollers 76 are driven for rotation at a timing synchronized with the movement of the document scanner 36 so that the copying sheet is correctly transferred to the drum 50. The timing rollers 76 are further operative to rectify the direction of the copying sheet to be fed to the peripheral surface of the drum 50. Each of the copy-sheet feed rollers 60 and 62 and each of the guide roller pairs 70 and 74 and timing roller pair 76 are driven from a main drive motor ($M_D$) of the apparatus by means of respectively associated clutches or other forms of actuators (not shown).

A copy-sheet transport belt assembly 78 is positioned posterior to the area where the copy sheet is to be separated from the image transfer drum 50. The copy sheet separated from the drum 50 is thus conveyed rearwardly through the belt assembly 78 to an image fixing assembly 80 provided at the rear of the belt assembly 78. The toner particles carried on the copy sheet are thus thermally fused and the toner images fixed on the copy sheet by means of this image fixing assembly 80. The copy sheet released from the image fixing assembly 80 is withdrawn from the apparatus through a copy-sheet discharge tray 82 attached to the housing 20 through a slot provided in the rear panel portion of the housing 20. The copying apparatus embodying the present invention has capabilities to reproduce images within an edited mode within a specified area or areas of a copying sheet. Such an edited mode of operation is performed with use of a selective charge eraser unit 84 located posterior to the main charger 52 and anterior to the developing stage 54.

The apparatus embodying the present invention further comprises various sensors and detectors which include a home position sensor 86 and a scan timing sensor 88 located in conjunction with the document scanner 36. The home position sensor 86 produces a home position signal ($S_{HP}$) of a logic "1" bit in the presence of the document scanner 36 in the home position thereof. The scan timing sensor 88 produces an output signal as the scanner 36 is driven for movement over a predetermined distance from its home position with respect to the document table 22. Also provided is a sensor (not shown) for detecting the position of the lens unit 22 with respect to the image transfer drum 50.

The sensors and detectors provided in the apparatus embodying the present invention further comprise cassette and copy-sheet size detector switches 90*a* and 92*a* associated with the first copy-sheet supply cassette 64*a* and cassette and copy-sheet size detector switches 90*b* and 92*b* associated with the second copy-sheet supply cassette 64*b*. The cassette detector switches 90*a* and 90*b* are responsive to the presence of the first and second copy-sheet supply cassettes 64*a* and 64*b*, respectively, and the copy-sheet size detector switches 92*a* and 92*b* are responsive to the sizes of copying sheets stored in the first and second copy-sheet supply cassettes 64*a* and 64*b*, respectively. There are further provided a color sensor 94 arranged in conjunction with the upper developing unit 54*a* to discriminate the type of the developing unit 54*a* and accordingly the color of the toner stored in the developing unit 54*a*. It is herein assumed by way of example that there are available three detachable developing units respectively for storing black, red (or magenta) and yellow toners, of which the black toner is stored in the lower developing stage 54*b*.

Figure 2:
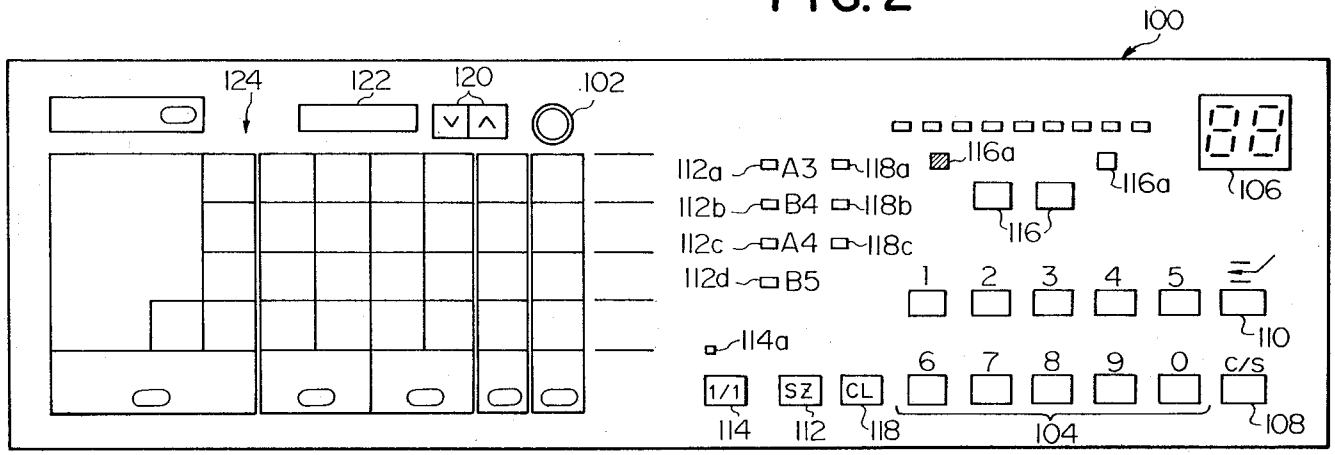
FIG. 2 is a plan view schematically showing the general configuration of the control panel forming part of the image duplicating apparatus illustrated in FIG. 1.

FIG. 2 shows the general configuration of a control panel 100 which forms part of the apparatus embodying the present invention. The control panel 100 comprises a print start switch 102 to enable the apparatus to start duplicating operation and a set of numerical switches 104 allocated to numerals 1, 2, . . . and 0, respectively, and used to enter a selected quantity of copy sheets to be printed. The quantity of copy sheets thus entered from the numerical switches 104 is displayed on a numerical data display window 106 and can be cleared from a clear/stop switch 108 (C/S) which may be used also for cancelling the instruction once entered from the print start switch 102. During printing of a preset quantity of copy sheets for a given document sheet, another document sheet may be duplicated in an interrupt mode entered at an interrupt request switch 110 (IR). The numerical switches 104 are to be used not only for entering a selected quantity of copy sheets to be printed but for entering numerical data representative of the coordinates to define a desired edited copy/erase area to be specified during an edited copying mode of operation. The numerical data thus entered from the switches 102 are also displayed on the numerical data display window 106.

The size of copy sheets to be used can be manually selected at a copy-sheet size select switch 112 (SZ) from among a predetermined number of sizes available. The selected size of copy sheets is displayed by any of copy-sheet size indicators 112*a* to 112*d* which are herein assumed to be respectively allocated to the standardized paper sizes A3, B4, A4 and B5 by way of example. The copy-sheet size select switch 112 is, in effect, operative to select one of the copy-sheet supply cassettes 64*a* and 64*b* currently installed on the apparatus shown in FIG. 1. On the control panel 100 are further provided a full-size ratio select switch 114 (1/1) for selecting the full-size ratio for copying, the switch 114 having an associated indicator 114*a*. Further provided on the control panel 100 are print density increment and decrement switches 116 with respectively associated indicators 116*a* to permit manual selection of a desired print density for the copy sheets to be printed. The print density is stepwise incremented with one of the switches 116 depressed or decremented with the other of the switches 116 depressed. Furthermore, the color of the imaged to be printed can be selected from among different available colors at a color select switch 118 (CL) having associated color indicators 118*a*, 118*b* and 118*c* allocated to different print colors such as black, red (or magenta) and yellow, respectively. The color select switch 118 is in effect operative to select one or two of the developing units 54*a* and 54*b* of the image developing stage 54 of the apparatus shown in FIG. 1. On the control panel 100 are further provided zoom switches 120 for continuously varying the coordinate values or magnification ratio entered for edited mode of copying operation. The numerical data continuously selected by the switches 120 are displayed on a magnification ratio display window 122 for visual assistance to the operator.

The control panel 100 of the apparatus embodying the present invention further comprises a touch panel section 124 arranged with various switches and indicators as schematically illustrated in FIG. 2. The details of such a touch panel section 124 will be described hereinafter.

Figure 3:
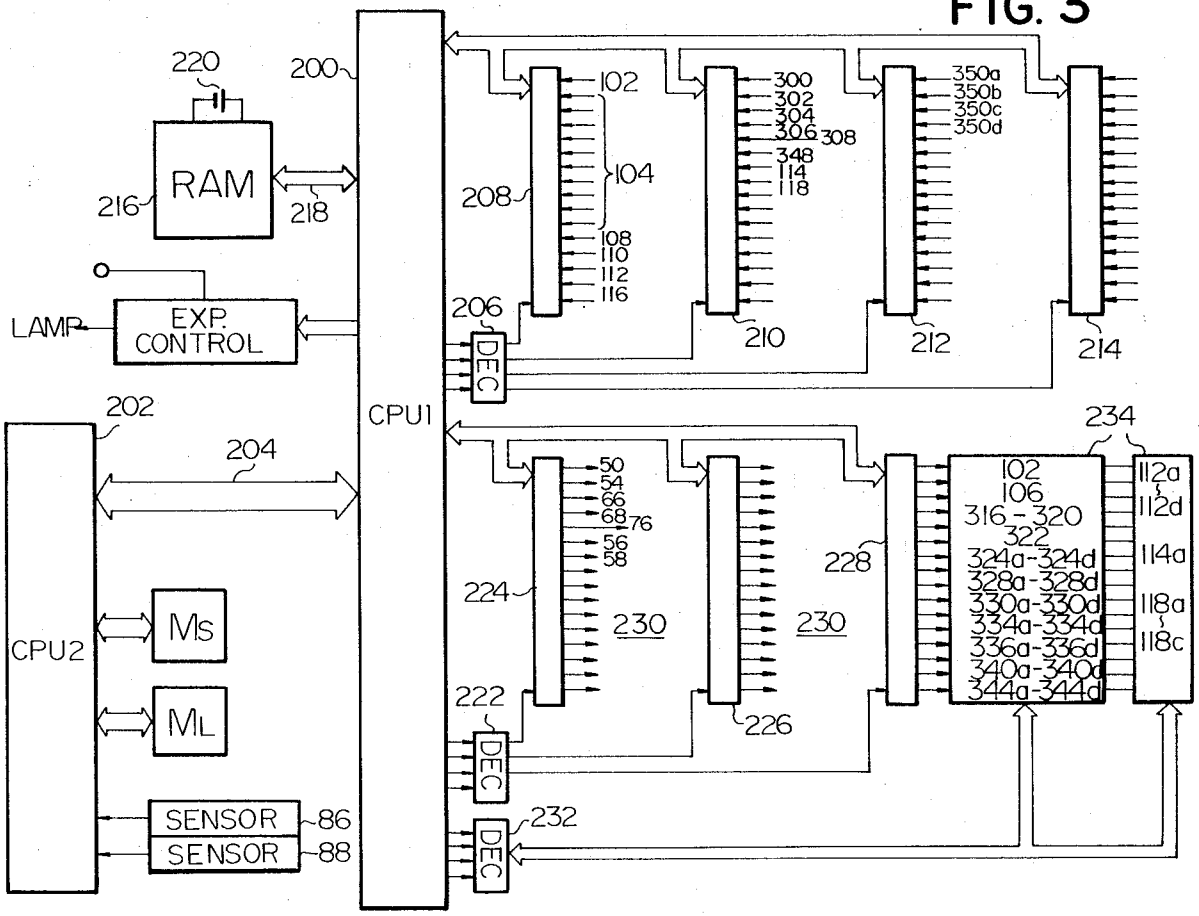
FIG. 3 is a diagram schematically showing the arrangement of a control circuit which may be incorporated in the image duplicating apparatus embodying the present invention.

FIG. 3 shows the general arrangement of a control circuit which may be used to achieve various modes and conditions of copying operation in the apparatus embodying the present invention. The control circuit comprises first and second microprocessors 200 and 202 (hereinafter referred to as CPU1, CPU2 and CPU3, respectively). The CPU1 200 and CPU2 202 have interrupt and data input and output ports connected together through a bidirectional bus 204. The CPU1 200 is mainly operative to control the operation of the image reproducing system 26 and paper feed mechanism 28 while the CPU2 202 is predominant over the operation of the optical scanning system 24. The CPU2 is mainly operative to control the operation of the optical document scanning system 24.

The first CPU1 200 has input terminals connected through a decoder 206 to input expander circuits 208, 210, 212 and 214 and through these expander circuits 208 to 214 to various switch elements (herein collectively represented by numeral 100) including those on the control panel 100. Data entered from such switch elements are stored into a random-access memory (RAM) 216 which is connected to the CPU1 through a bidirectional bus and which has a backup power supply source 220. The CPU1 200 further has output terminals connected through a decoder 222 to output expander circuits 224, 226 and 228 and through these expander circuits 224 to 228 to the drivers and actuators (herein collectively represented by numeral 230) for the main drive motor, the motor incorporated in the developing stage 54, the clutches for the copy sheet feed and guide rollers 66, 68, 70 and 74, the clutch for the timing rollers 76, the chargers 52, 56 and 58, and the eraser lamp 62. The CPU1 200 further has output terminals connected through a decoder 232 to the various indicators and display units (herein collectively represented by numeral 234) provided on the control panel 100 on the control panel 100.

The second CPU2 202 has input terminals connected to the home position sensor 86 and scan timing sensor 88 provided in association with the optical scanning system 24 and is operative to control the driver circuits for the scanner drive motor $M_S$ and the stepper motor $M_L$ for the magnification lens unit 42. The CPU2 202 is thus responsive to signals from the home position and scan timing sensors 86 and 88 to regulate the operation of the motors included in the optical scanning system 24 under the control of the first CPU1 200 through the bus 204.

The first CPU1 200 may be further connected to an exposure control circuit 236 which controls the intensity of illumination by the exposure lamp 32.

Figure 4:
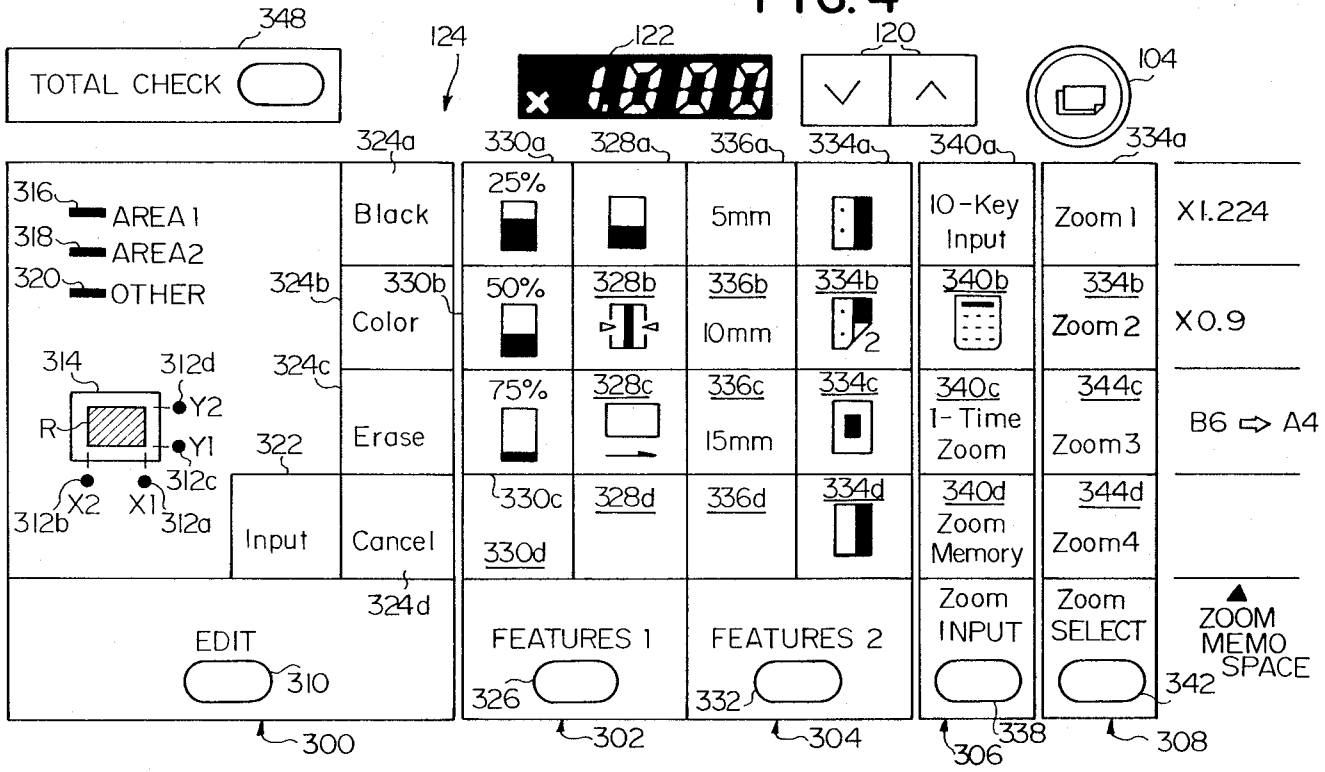
FIG. 4 is a plan view showing, to an enlarged scale, the arrangement of the various switch areas provided in the touch panel section which forms part of the control panel illustrated in FIG. 2.

FIG. 4 shows to an enlarged scale the arrangement of the touch panel section 124 of the control panel 100. The touch panel section 124 comprises first, second, third, fourth and fifth subsections 300, 302, 304, 306 and 308 each including a mode group or "menu" select switch and a plurality of switch areas. Each of the subsections 300 to 308 is assigned to a group of different modes of operation any of which can be selected from the menu select switch included in the particular subsection.

The first subsection 300 is provided for the selection of an edited copy mode which is selected from a menu select switch implemented by an edited copy mode select switch 310 to enable entry of various instructions and data for an edited mode of copying operation. When this edited copy mode select switch 310 is depressed to select the edited copying mode of operation, two of the indicators 118*a* associated with the color select switch 118, viz., the indicators respectively allocated to the two different print colors available by the upper and lower developing units 54*a* and 54*b* are turned on to illuminate or flicker. The two print colors available by the developing units 54*a* and 54*b* are herein assumed to be red and black, respectively, by way of example.

In association with the edited copy mode select switch 310 are arranged first to fourth indicators which consist of two x-coordinate indicators 312*a* and 312*b* and two y-coordinate indicators 312*c* and 312*d*. To provide a visible assistance to the designation of the coordinates of such a copy/erase area through the switch 312, there is further provided in the touch panel section 124 an area display screen 314 on which a desired edited copy/erase area R to be printed or erased is to be visually indicated. An xy-coordinate system is thus taken into account on this area display screen 314 as having an axis of abscissa corresponding to the direction of circumferential direction of the drum 50 and an axis of ordinate corresponding to the axial direction of the drum 50, with an origin at the right lower corner of the screen 314. The desired edited copy/erase area R can thus be defined by the combination of x-coordinates $X_1$ and $X_2$ and y-coordinates $Y_1$ and $Y_2$ which may be designated from any of the numerical switches 104.

In the copying apparatus according to the present invention, it is assumed that there may be specified and displayed on the area display screen 314 two different edited copy/erase areas of a copying sheet. These two edited copy areas will be herein referred to respectively as "edited copy/erase area 1" or simply as "area 1" and "edited copy/erase area 2" or simply as "area 2". The remaining area of the copying sheet surrounding these areas 1 and 2 is referred to as "other" area. The area R shown displayed on the area display screen 314 is thus assumed to be representative of one of such two edited copy/erase areas 1 and 2. The images within each of the edited copy/erase areas 1 and 2 or the "other" area of a copying sheet may be printed in any of the two colors available or may be blanked out or "erased". Entry of data for the edited copy/erase areas 1 and 2 is requested by successive illumination by indicators 316 and 318, and entry of data for the "other" area surrounding the edited copy/erase areas 1 and 2 is indicated by illumination by an indicator 320.

The coordinate data for each of the desired edited copy/erase areas 1 and 2 are specified with use of the numerical switches 104 and/or the zoom switches 120 and numerical data display window 106 and entered with a data enter switch area 322 depressed. On the other hand, the selection between the two colors for each of the three areas can be entered through a black select switch area 324*a* and a color switch area 324*b*. The black switch area 324*a* is used for selecting black as the print color in which the images within the desired edited copy/erase area 1 or 2 or in the "other" area are to be printed. The color switch area 324*b* is used for selecting another print color such as red (or yellow) as the color in which the images within the desired edited copy/erase area 1 or 2 or in the "other" area are to be printed. The selection of the erasure of one or more of the three areas can be entered through an erase switch area 324*c* which may be used where it is desired to erase the images within one or both of the desired edited copy/erase area 1 or 2 or the "other" area. If there are no data desired to be entered for one or both of the edited copy/erase areas 1 and 2 or for the "other" area, a cancel switch area 324*d* may be depressed.

The charge eraser unit 84 provided in the apparatus shown in FIG. 1 is composed of a number of light emitter elements arranged in a single linear array. The linear array of the light emitter elements is positioned close to the peripheral surface of the image transfer drum 50 and extends in parallel to the axis of rotation of the drum 50. When the light emitter elements of such an charge eraser unit 84 are activated to illuminate selectively with the drum 50 being driven for rotation, the charges on those small areas of the drum surface which are illuminated by the selected light emitter elements are caused to disappear. Accordingly, no latent images can be produced on the particular areas of the drum surface when the drum surface is irradiated with an information carrying beam. When some particular ones of the light emitter elements are activated from one specified time to another, the charges are caused to dissipate on the area of the drum surface as defined by the four coordinate points given by the x-coordinates $X_1$ and $X_2$ and the y-coordinates $Y_1$ and $Y_2$. There can thus be produced no latent images within this area when the drum 50 is illuminated with an information carrying beam incident on the drum surface. The area is displayed as the edited copy/erase area R on the display screen 316 shown in FIG. 4.

The second subsection 302 of the touch panel section 124 is provided for the selection of a feature "1" mode which is selected from a menu select switch implemented by a feature "1" mode select switch 326. The feature "1" mode select switch 326 is associated with a first column of four switch areas 328*a* to 328*d* and a second column of four switch areas 330*a* to 330*d* located to the left of the switch areas 328*a* to 328*d*, respectively.

The third subsection 304 of the touch panel section 124 is provided for the selection of a feature "2" mode which is selected from a menu select switch implemented by a feature "2" mode select switch 332. The feature "2" mode select switch 332 is associated with a first column of four switch areas 334*a* to 334*d* and a second column of four switch areas 336*a* to 336*d* located to the left of the switch areas 334*a* to 334*d*, respectively. By way of example, the switch areas 334*a* and 334*b* of the first column may be used for the selection of binding margin set modes, the switch area 334*c* may be used for the selection of a frame erase mode, and the switch area 334*d* may be used for the selection of a punch-hole erase mode. The switch areas 336*a*, 336*b* and 336*c* of the second column may be used for the selection of one of predetermined margin frame widths of, for example, 5 mm, 10 mm and 15 mm for the margin to be set by the switch 334*a* or 334*b* or the frame to be erased by the switch 334*c*. Thus, the mode or condition achievable by any of the switches 336*a* to 336*c* of the second column is subsidiary to the mode or condition selected by any of the switches 334*a* to 334*c* of the first column. It may be noted that the switch area 334*d* for the selection of a punch-hole erase mode has no mode or condition subsidiary to the punch-hole erase mode selected by the particular switch 334*d*.

The fourth subsection 306 of the touch panel section 124 is provided for the selection of a zoomed magnification ratio input mode which is selected from a menu select switch implemented by a zoomed magnification ratio input mode select switch 338. The zoomed magnification ratio input mode select switch 338 is associated with a column of four switch areas 340*a* to 340*d*. By way of example, the switch area 340*a* may be used for the selection of a mode in which a desired magnification ratio is entered from the numerical switches 104. The switch area 340*b* may be used for the selection of a mode for calculating a magnification ratio on the basis of any desired numerical data. The switch area 340*c* may be used for the selection of a mode for establishing a desired magnification ratio to be used only for a single cycle of copying operation. The switch area 340*d* may be used for the selection of a mode in which the desired magnification ratio is to be stored into any one of the magnification memory areas (not shown) provided in the CPU1 200.

The fifth subsection 308 of the touch panel section 124 is provided for the selection of a zoomed magnification ratio select mode which is selected from a menu select switch implemented by a zoomed magnification ratio select mode select switch 342. The zoomed magnification ratio select mode select switch 342 is associated with a column of four switch areas 344*a* to 344*d* which may be used for the selection of the magnification memory areas provided in the CPU1 200.

To the right of the touch panel section 124 are provided user's memorandum areas 346 which may be labelled with any marks, symbols or other indications desired by the user. Indicated at 348 is a total value read switch.

Figure 5:
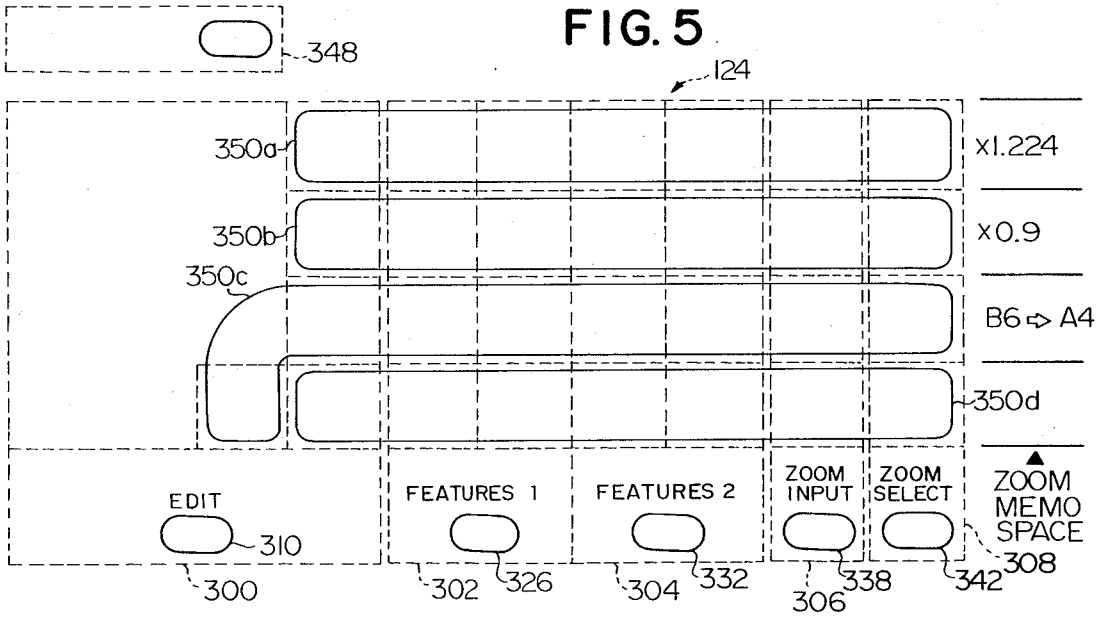
FIG. 5 is a plan view showing the arrangement of switch strips which form the individual switch areas of the touch panel section illustrated in FIG. 4.

In the touch panel section 124 on the control panel 100 of the apparatus embodying the present invention, the respective menu switches 310, 326, 332, 338 and 342 of the subsections 300, 302, 304, 306 and 308 are located in a single row. In addition, the switch areas 322, 324*a* to 324*d*, 328*a* to 328*d*, 330*a* to 330*d*, 334*a* to 334*d*, 336*a* to 336*d*, 340*a* to 340*d*, and 344*a* to 344*d* as hereinbefore described are formed by first, second, third, fourth and fifth switch strips 350*a*, 350*b*, 350*c*, 350*d* and 350*e* as shown in FIG. 5. The first strip 350*a* form the switch areas 324*a*, 328*a*, 330*a*, 334*a*, 336*a*, 340*a* and 344*a* arranged in a first row of the subsections 300, 302, 304, 306 and 408. The second switch strip 350*b* form the switch areas 324*b*, 328*b*, 330*b*, 334*b*, 336*b*, 340*b* and 344*b* arranged in a second row of the subsections 300, 302, 304, 306 and 408. The third switch strip 350*c* form the switch areas 324*c*, 328*c*, 330*c*, 334*c*, 336*c*, 340*c* and 344*c* arranged in a third row of the subsections 300, 302, 304, 306 and 408. The third switch strip 350*c* further forms the switch areas 322 of the subsection 300 as shown. The fourth switch strip 350*d* form the switch areas 324*d*, 328*d*, 330*d*, 334*d*, 336*d*, 340*d* and 344*d* arranged in a fourth row of the subsections 300, 302, 304, 306 and 408.

Figure 6:
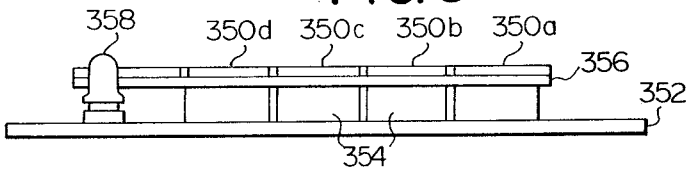
FIG. 6 is a side elevation view of the switch areas forming each of the columns of switch areas in the touch panel section illustrated in FIG. 5.

FIG. 6 is a side elevation view of the switch areas of the touch panel section illustrated in FIG. 5 and may by way of example show the switch areas 344*a* to 344*d* forming the column of the fifth subsection 308 of the touch panel section 124 shown in FIG. 4. As will be seen from FIG. 6, the touch panel section 124 is provided on a printed circuit board 352 and comprises light emitter elements 354 located in the individual switch areas 344*a* to 344*d*, respectively, forming the column of the subsection 308 of the touch panel section 124. Over these light emitter elements 354 is positioned a film 356 on which are printed the marks, symbols or other indications representative of the modes or conditions allocated to the individual switch areas 344*a* to 344*d*, respectively, of the subsection 308. On the film 356 are provided portions of the switch strips 350*a* to 350*d*, the portions of the switch strips 350*a* to 350*d* forming the individual switch areas 344*a* to 344*d*, respectively, of the subsection 308. Each of the switch strips 350*a* to 350*d* is herein assumed to be formed of a flexible transparent layer. On the other hand, each of the menu switches such as the zoomed magnification ratio select mode select switch 342 herein shown is provided in the form of an ordinary push-button switch element having a key top member 358.

Figure 7:
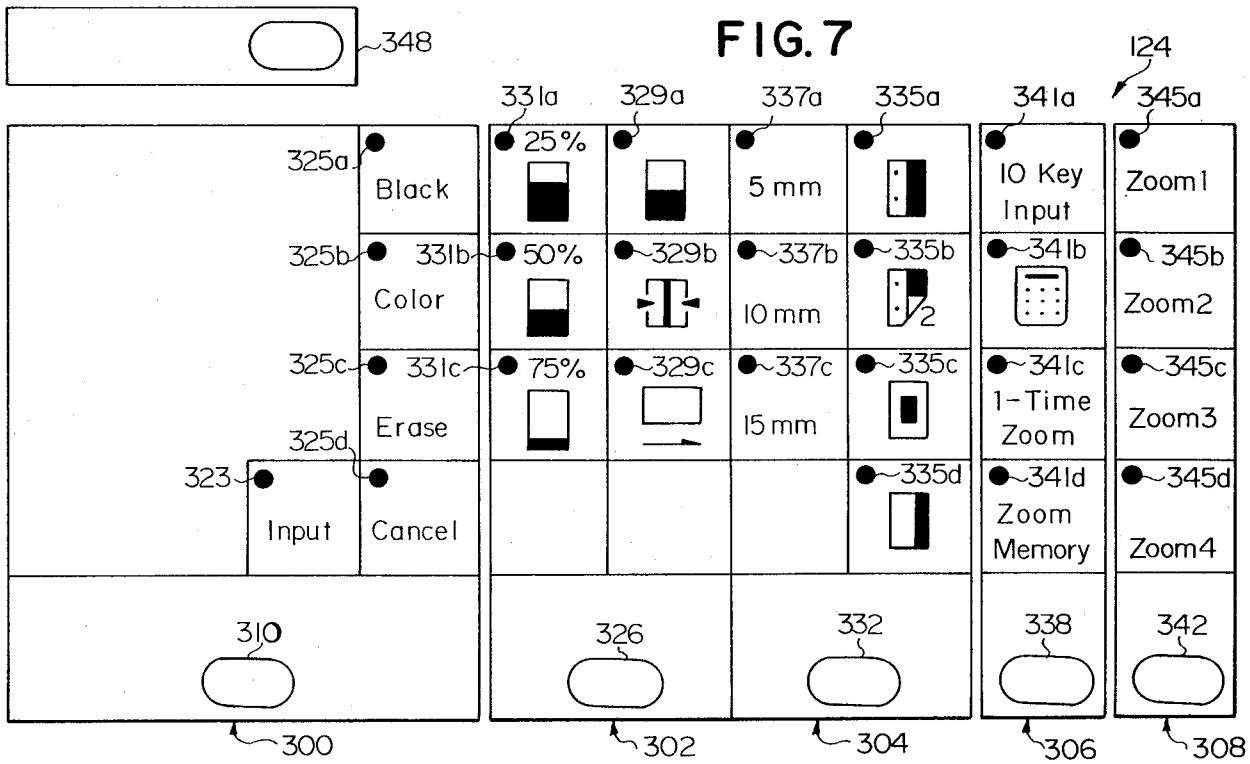
FIG. 7 is a view similar to FIG. 4 but shows the arrangement of the indicators respectively associated with the switch areas in the touch panel section illustrated in FIG. 4.

The individual switch areas of the touch panel section 124 thus arranged have respectively associated indicators each of which is to be turned on to flicker or illuminate when the associated switch area is manually depressed. Such indicators are formed by the light emitter elements 354 provided in the switch configuration shown in FIG. 6 and each implemented by a light emitting diode (LED). The indicators are visually accessible through apertures formed in the film 356 bearing the marks, symbols or other indications and are herein shown in the forms of solid spots, as indicated in FIG. 7 at 323, 325*a* to 325*d*, 329*a* to 329*c*, 331*a* to 331*c*, 335*a* to 335*d*, 337*a* to 337*c*, 341*a* to 341*d*, and 345*a* to 345*d*.

Figure 8A:
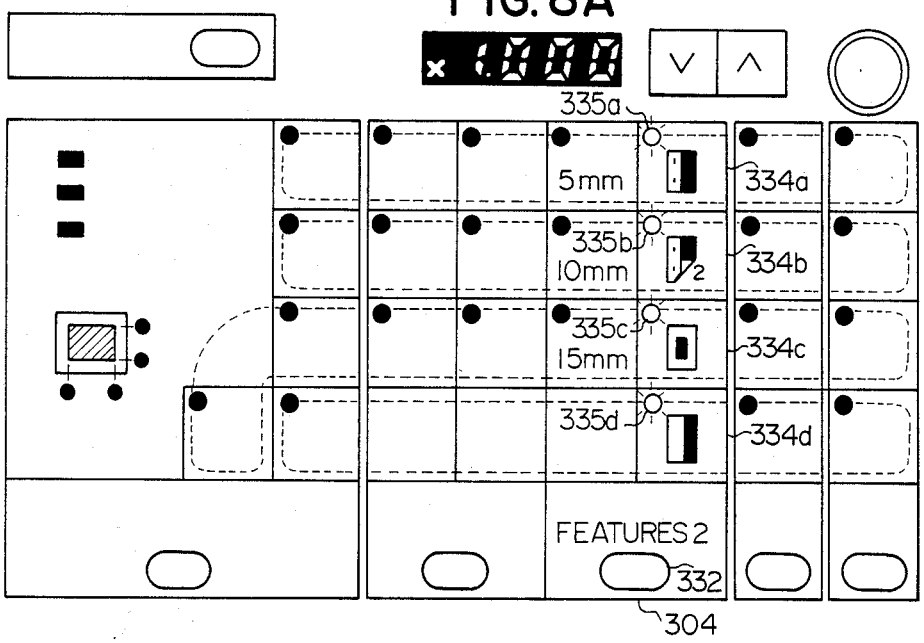
FIGS. 8A to 8D are plan views showing various conditions of the touch panel section as produced when different menue switches and switch areas of the touch panel section are depressed.
Figure 8B:
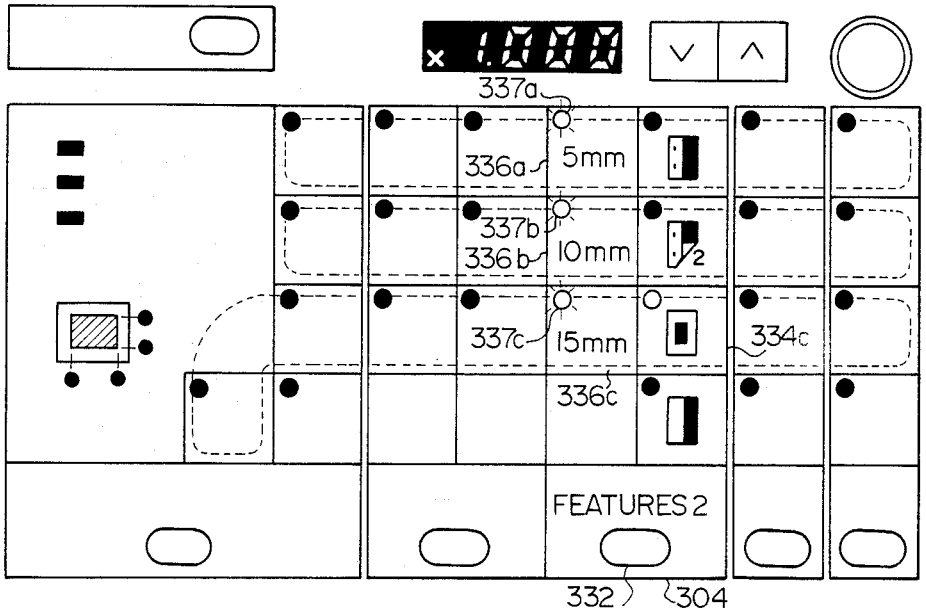
Figure 8C:
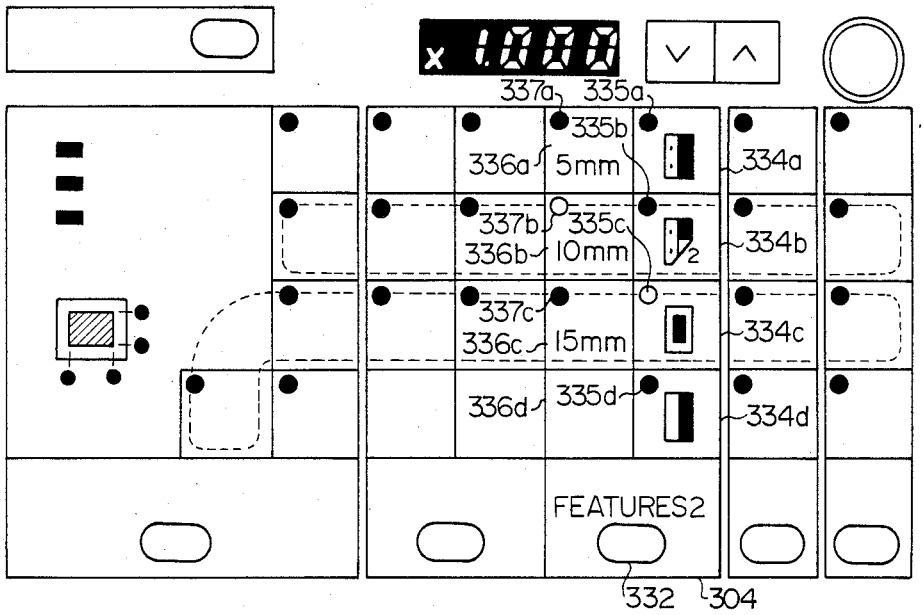

At an initial stage after the apparatus has been switched in, only the print start switch 104 and the magnification ratio display window 122 are turned on to illuminate in green on the control panel 100. The print start switch 104 thus illuminating in green is in a condition allowing the operator to start copying operation through the switch 104. The operator of the apparatus may then depress the feature "2" mode select switch 332 in the touch panel section 124. With the feature "2" mode select switch 332 depressed, the indicators 335*a*, 335*b*, 335*c* and 335*b* associated with the switch areas 334*a*, 334*b*, 334*c* and 334*b*, respectively, of the first column of the third subsection 304 are turned on to flicker each as indicated by a hollow spot with radials in FIG. 8A. Simultaneously when the indicators 335*a* to 335*b* are thus turned on to flicker, the print start switch 104 is conditioned to illuminate in red. The print start switch 104 thus illuminating in red is in a condition prohibiting the operator from starting copying operation through the switch 104. The operator of the apparatus may then depress the third switch area 334*c* assigned to the frame erase mode. For this purpose, the operator may depress any one of the switch areas 322, 324*c*, 328*c*, 330*c*, 336*c*, 340*c* and 344*c* commonly formed by the third switch strip 350*c*. The third switch area 334*c* or any one of these switch areas being thus depressed, the indicators 335*a*, 335*b* and 335*d* associated with the other switch areas 334*a*, 334*b* and 334*d*, respectively, of the first column of the third subsection 304 are caused to turn off and, in turn, the indicators 337*a*, 337*b*, 337*c* and 337*b* associated with the switch areas 336*a*, 336*b*, 336*c* and 336*b*, respectively, of the second column of the subsection 304 are turned on to flicker as indicated in FIG. 8B. The operator of the apparatus may now depress the second switch area 336*c* assigned to the 10 mm margin or frame width. In this instance, the same result will be achieved if the operator depresses any one of the switch areas 324*b*, 328*b*, 330*b*, 334*b*, 340*b* and 344*b* commonly formed by the second switch strip 350*b*. The second switch area 336*b* or any one of these switch areas being thus depressed, the indicators 337*a* and 337*c* associated with the other switch areas 336*a* and 336*c*, respectively, of the second column of the subsection 304 are caused to turn off as indicated in FIG. 8C. Entry of instructions through the touch panel section 124 being thus complete, the print start switch 104 is for a second time conditioned to illuminate in green.

Figure 8D:
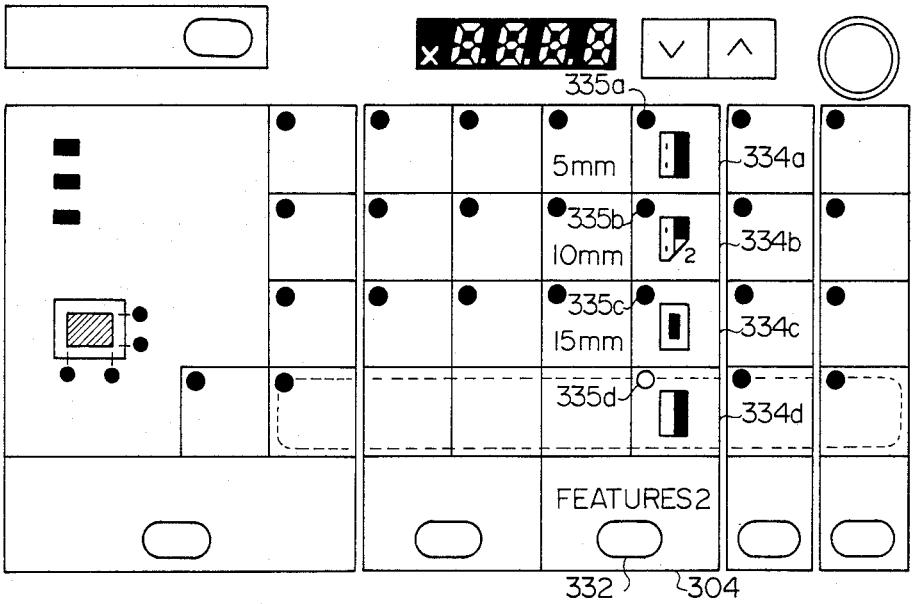

If the switch area 334*d* for the selection of the punch-hole erase mode is depressed after the feature "2" mode select switch 304 is depressed, then only the indicator 335*b* associated with the particular switch area 334*d* is turned on to flicker with the indicators 335*a*, 335*b* and 335*c* for the switch areas 334*a*, 334*b* and 334*c*, respectively, of the subsection 304 turned off, as indicated in FIG. 8D. This is because of the fact that the switch area 334*d* for the selection of the punch-hole erase mode has no mode or condition subsidiary to the mode selected by the particular switch 334*d*. Thus, entry of instructions through the touch panel section 124 is now complete so that the print start switch 104 is for a second time conditioned to illuminate in green allowing the operator to start copying operation.

As will have been understood from the foregoing description that a total of ($\underline{m}\times\underline{n}$) number of switch areas are available and accordingly the user of the apparatus is allowed to select one out of a total of ($\underline{m}\times\underline{n}$) number of modes or conditions through provision of an $\underline{m}$ number of menu switches and an $\underline{n}$ number of switch strips. If, in addition, there are two or more sets of switch areas provided in association with one of the menu switches so that the modes or conditions dictated by one set of switch areas are subsidiary to those dictated by another set of switch areas, more than ($\underline{m}\times\underline{n}$) number of modes or conditions are available for selection through provision of the $\underline{m}$ number of menu switches and $\underline{n}$ number of switch strips.

Figure 9:
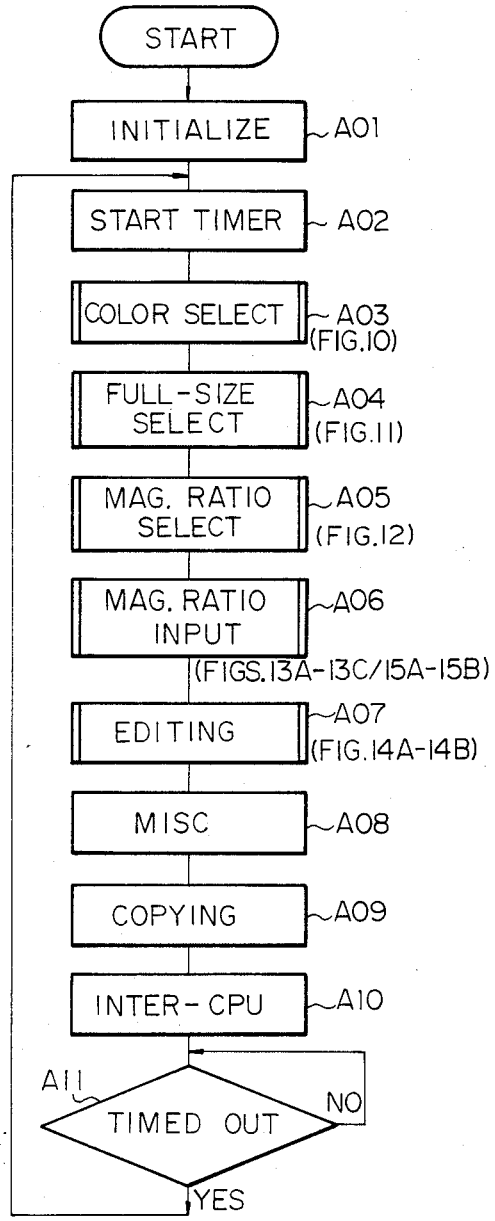
FIG. 9 is a flowchart showing an example of the main routine program to be executed by a master microprocessor unit included in the control circuit illustrated in FIG. 3.

FIG. 9 shows the main routine program to be executed by the first or master CPU1 200 provided in the control circuit described with reference to FIG. 3. The routine program starts with the copying apparatus switched in and initializes the master CPU1 200 at a step A01 so that all the copying conditions and modes of operation to be controlled by means of the CPU1 200 are selected in accordance with prescribed "default" rules. An internal timer of the system is then initiated at a step A02 to count the time interval predetermined for a single complete iteration through the routine program.

The master CPU1 200 may then execute a color select subroutine program A03 by which one or both of the developing units 54*a* and 54*b* respectively storing red-colored and black-colored toner particles may be selected for use depending upon an instruction signal or signals entered at the control panel 100. The details of the color select subroutine program A03 will be hereinafter described with reference to FIG. 10. The color select subroutine program A03 may be followed by a fullsize copy mode select subroutine program A04 to establish a copying mode of operation using a magnification ratio of 1:1. The details of this full-size copy mode select subroutine program A04 will be hereinafter described with reference to FIG. 11.

The master CPU1 408 may thereafter execute a zoomed magnification ratio select mode select subroutine program A05 responsive to depression of the zoomed magnification ratio select mode select switch 342 of the subsection 308 depressed in the touch panel section 124. The details of this zoomed magnification ratio select mode select subroutine program A05 will be hereinafter described with reference to FIG. 12. The zoomed magnification ratio select mode select subroutine program A05 may be followed by a zoomed magnification ratio input mode select subroutine program A06 responsive to depression of the zoomed magnification ratio input mode select switch 338 of the subsection 306 depressed in the touch panel section 124. The details of this zoomed magnification ratio input mode select subroutine program A06 will be hereinafter described with reference to FIGS. 13A, 13B and 13C or to FIGS. 15A and 15B which show a modification of the subroutine program illustrated in FIGS. 13A to 13C.

Figure 14A:
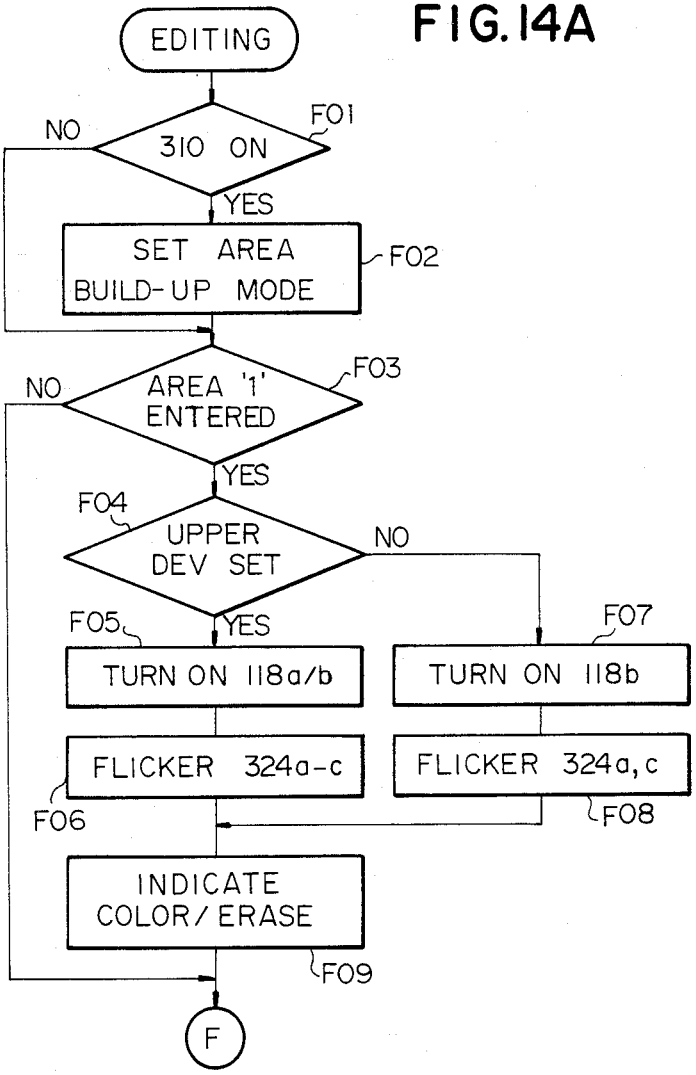
FIGS. 14A and 14B are flowcharts showing a copy-area editing subroutine program included in the main routine program illustrated in FIG. 9.

The master CPU1 200 may then execute a copy-area editing subroutine program A07 to establish an edited mode of copying operation. The details of the copy-area editing subroutine program A07 will be hereinafter described with reference to FIGS. 14A and 14B. Subsequently to the copy-area editing subroutine program A07, the master CPU1 200 may execute a subroutine program A08 to process various instruction and data signals supplied from the control panel 100 while generating instructions to update the numerical data on the display window 106 of the control panel 100. Thereafter, the master CPU1 200 may further execute a copying control subroutine program A09 predominant over the copying operation to be performed by the apparatus in accordance with the various instruction and data signals supplied from the control panel 100. The master CPU1 408 may further execute an inter-CPU communication data updating subroutine program A10 by which the data received by the CPU1 200 may be transferred to an internal memory unit incorporated within the CPU1 and the data thus processed in the internal memory unit is transferred to the random access memory 210 for transmission to the other or slave microprocessors such as the second CPU2 202. Upon lapse of the predetermined time interval as detected at a step A11 after the internal timer of the system has been initiated at the step A02, the system reverts to the step A02 and recycles the subroutine programs A03 to A10.

Description will be hereinafter made with reference to FIG. 10 to FIGS. 15A to 15C in regard to the various subroutine programs thus included in the main routine program to be executed by the master CPU1 200.

Figure 10:
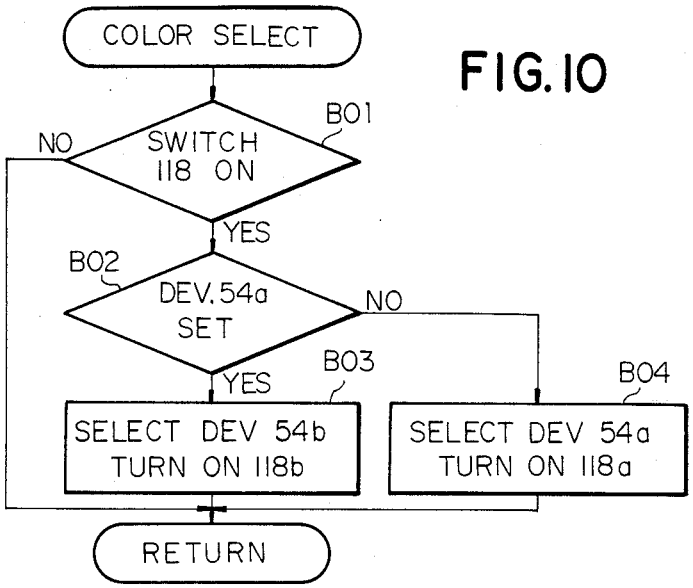
FIG. 10 is a flowchart showing a color select subroutine program included in the main routine program illustrated in FIG. 9.

FIG. 10 is a flowchart showing the details of the color select subroutine program A03 included in the main routine program illustrated in FIG. 9. The color select subroutine program A03 starts with a decision step B01 at which it is queried whether or not there is present a signal produced with the color select switch 118 depressed on the control panel 100. In the presence of such a signal, it is further confirmed at a step B02 whether or not the upper developing unit 54*a* had been selected until the signal was produced with the switch 118 depressed. If the answer for this step B02 is given in the affirmative, an instruction signal is issued at a step B03 so that the lower developing unit 54*b* storing the black-colored toner particles is selected for use and accordingly the indicator 118*a* assumed to be allocated to the black print color is turned on to illuminate. If, conversely, the answer for the step B02 is given in the negative, an instruction signal is issued at a step B04 so that the upper developing unit 54*a* storing the red-colored toner particles is selected for use and accordingly the indicator 118*a* assumed to be allocated to the red print color is turned on to illuminate.

Figure 11:
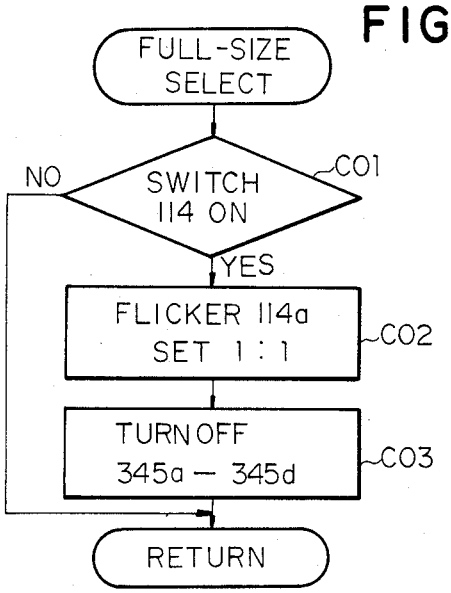
FIG. 11 is a flowchart showing a full-size copy mode select subroutine program included in the main routine program illustrated in FIG. 9.

FIG. 11 shows the details of the full-size copy mode select subroutine program A04 included in the main routine program illustrated in FIG. 9. The full-size copy mode select subroutine program A04 starts with a decision step C01 at which it is queried whether or not there is present a signal produced with the full-size ratio select switch 114 depressed on the control panel 100 for selecting the full-size ratio for copying. In the presence of such a signal, an instruction signal is issued at a step C02 to turn on the indicator 114*a* associated with the full-size ratio select switch 114 and to drive the lens unit 42 to move to a position providing a one-to-one magnification ratio for copying. The step C02 is followed by a step C03 at which an instruction signal is issued to turn off all the indicators 345*a* to 345*d* respectively associated with the switch areas 344*a* to 344*d* of the fifth subsection 308 of the touch panel section 124.

Figure 12:
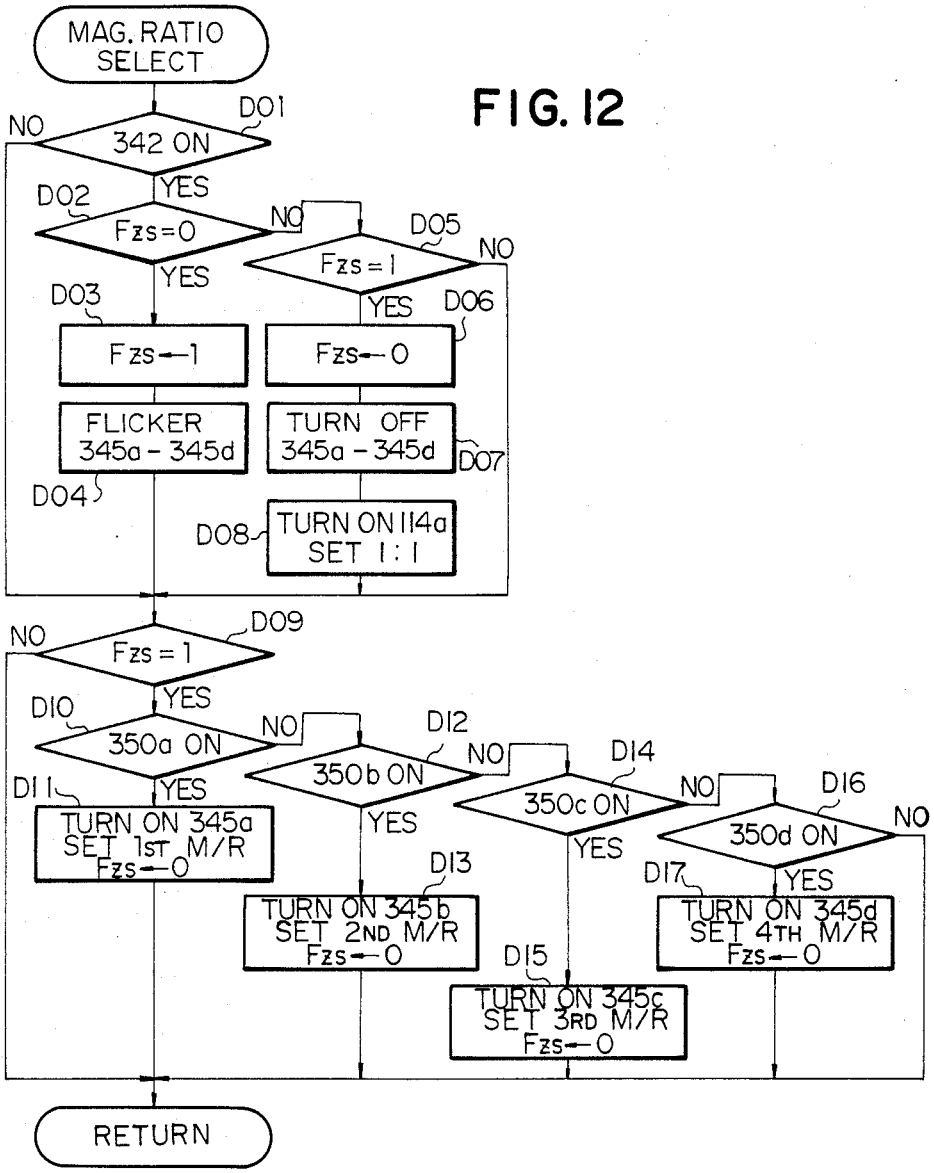
FIG. 12 is a flowchart showing a zoomed magnification ratio select mode subroutine program included in the main routine program illustrated in FIG. 9.

FIG. 12 shows a zoomed magnification ratio select mode select subroutine program A05 also included in the main routine program illustrated in FIG. 9. The zoomed magnification ratio select mode select subroutine program A05 starts with a decision step D01 at which it is queried whether or not there is present a signal produced with the zoomed magnification ratio select mode select switch 342 depressed in the touch panel section 124. In the presence of such a signal, it is further tested at a step D02 whether or not a status flag $F_{ZS}$ is of a logic "0" state. If it is found that the status flag $F_{ZS}$ is of logic "0" state, the status flag $F_{ZS}$ is shifted to a logic "1" state at a step D03. The step D03 is followed by a step D04 at which an instruction signal is issued so that all the indicators 345*a* to 345*d* respectively associated with the switch areas 344*a* to 344*d* are turned on to flicker in the fifth subsection 308 of the touch panel section 124. If it is found at the step D02 that the status flag $F_{ZS}$ is of logic "1" state, then the status flag $F_{ZS}$ is shifted to logic "0" state at a step D05. The step D05 is followed by a step D06 at which an instruction signal is issued so that all the indicators 345*a* to 345*d* respectively associated with the switch areas 344*a* to 344*d* are turned off in the fifth subsection 308 of the touch panel section 124. Subsequently to the step D07, a step D08 is followed to issue an instruction signal turn on the indicator 114*a* associated with the full-size ratio select switch 114 and to drive the lens unit 42 to move to a position providing a one-to-one magnification ratio for copying.

If it is found at the step D01 that there is no signal produce with the zoomed magnification ratio select mode select switch 342 depressed or subsequently to the step D04 or step D08, it is further tested at a step D09 whether or not the status flag $F_{ZS}$ is of logic "1" state. If it is found that the status flag $F_{ZS}$ is of the logic "1" state, it is queried at a step D10 whether or not there is present a signal produced with the first switch strip 350*a* depressed in the touch panel section 124. In the presence of such a signal, the step D10 is followed by a step D11 at which the status flag $F_{ZS}$ is shifted to logic "0" state and an instruction signal is issued so that only the indicator 345*a* associated with the switch area 344*a* is turned on to flicker with all the other indicators 345*b* to 345*d* for the switch areas 344*b* to 344*d* turned off in the fifth subsection 308 of the touch panel section 124. At this step D11 is further issued an instruction signal to drive the lens unit 42 to move to a position providing a first predetermined magnification ratio memorized in the magnification memory area selected from the switch area 344*a*.

If it is found at the step D09 that there is no signal produced with the first switch strip 350*a* depressed in the touch panel section 124, it is further tested at a step D12 whether or not there is present a signal produced with the second switch strip 350*b* depressed in the touch panel section 124. In the presence of such a signal, the step D12 is followed by a step D13 at which the status flag $F_{ZS}$ is shifted to logic "0" state and an instruction signal is issued so that only the indicator 345*b* associated with the switch area 344*b* is turned on to flicker with all the other indicators 345*a*, 345*c* and 345*d* for the switch areas 344*a*, 344*c* and 344*d* turned off in the subsection 308. At this step D13 is further issued an instruction signal to drive the lens unit 42 to move to a position providing a second predetermined magnification ratio memorized in the magnification memory area selected from the switch area 344*b*.

If it is found at the step D12 that there is no signal produced with the second switch strip 350*b* depressed in the touch panel section 124, it is further tested at a step D14 whether or not there is present a signal produced with the third switch strip 350*c* depressed in the touch panel section 124. In the presence of such a signal, the step D14 is followed by a step D15 at which the status flag $F_{ZS}$ is shifted to logic "0" state and an instruction signal is issued so that only the indicator 345c associated with the switch area 344c is turned on to flicker with all the other indicators 345a, 345b and 345d for the switch areas 344a, 344b and 344d turned off in the subsection 308. At this step D15 is further issued an instruction signal to drive the lens unit 42 to move to a position providing a third predetermined magnification ratio memorized in the magnification memory area selected from the switch area 344c.

If it is found at the step D14 that there is no signal produced with the third switch strip 350c depressed in the touch panel section 124, it is further tested at a step D16 whether or not there is present a signal produced with the fourth switch strip 350d depressed in the touch panel section 124. In the presence of such a signal, the step D16 is followed by a step D17 at which the status flag $F_{ZS}$ is shifted to logic "0" state and an instruction signal is issued so that only the indicator 345d associated with the switch area 344d is turned on to flicker with the indicators 345a to 345c for all the other switch areas 344a to 344c turned off in the subsection 308. At this step D17 is further issued an instruction signal to drive the lens unit 42 to move to a position providing a fourth predetermined magnification ratio memorized in the magnification memory area selected from the switch area 344d. If it is found at the step D16 that there is no signal produced with the fourth switch strip 350d depressed in the touch panel section 124 or subsequently to any of the steps D11, D13, D15 and D17, the system recycles the subroutine program.

Figure 13A:
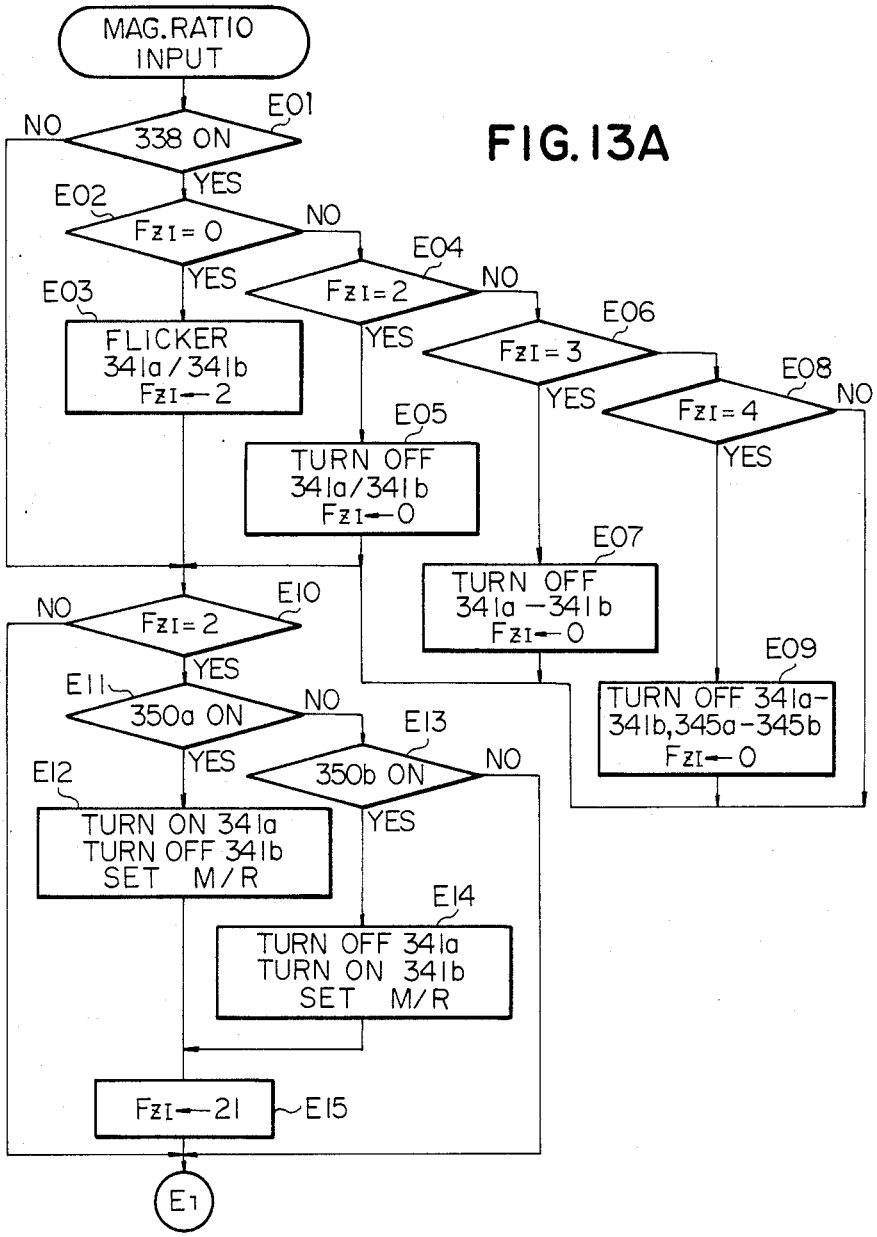
FIGS. 13A, 13B and 13C are flowcharts showing a zoomed magnification ratio input mode select subroutine program included in the main routine program illustrated in FIG. 9.
Figure 13B:
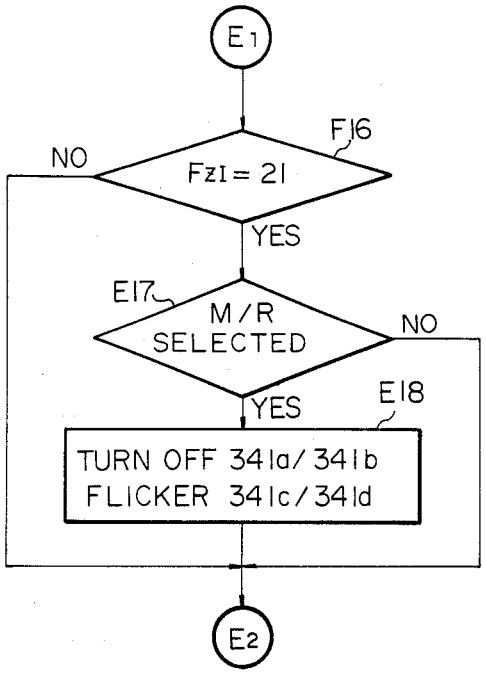
Figure 13C:
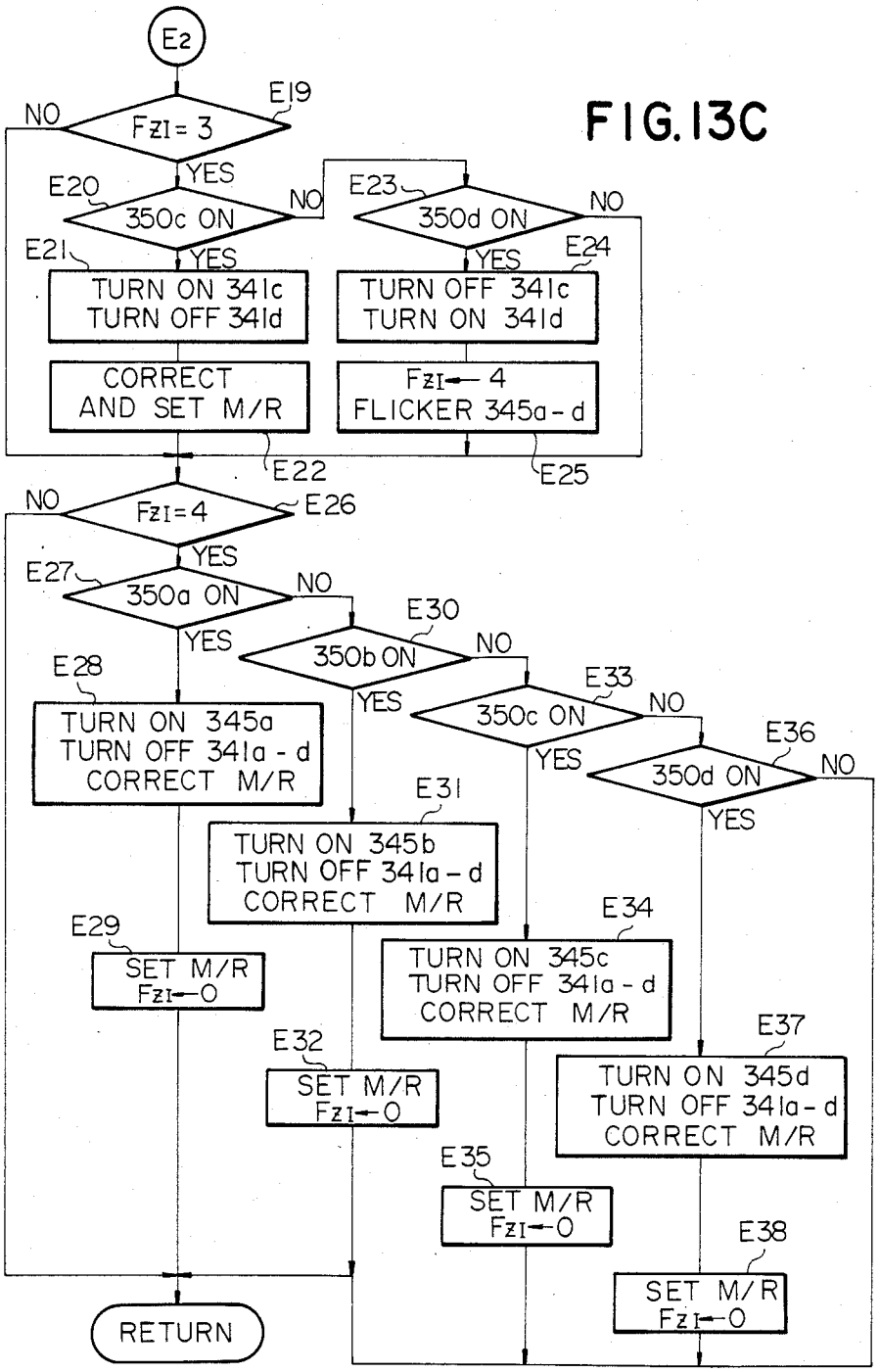

FIGS. 13A, 13B and 13C show the zoomed magnification ratio input mode select subroutine program A06 further included in the main routine program illustrated in FIG. 9. The zoomed magnification ratio input mode select subroutine program A06 starts with a decision step E01 at which it is queried whether or not there is present a signal produced with the zoomed magnification ratio input mode select switch 338 depressed in the touch panel section 124. In the presence of such a signal, it is further tested at a step E02 whether or not a status flag $F_{ZI}$ is of a "0" state. If it is found that the status flag $F_{ZI}$ is of the "0" state, the step E02 is followed by a step E03 at which the status flag $F_{ZI}$ is shifted to a "2" state and an instruction signal is issued so that the indicators 341a and 341b respectively associated with the switch areas 340a and 340b are turned on to flicker in the fourth subsection 306 of the touch panel section 124. Under these conditions, a magnification ratio is entered either from the numerical switches 104 or through calculation. If it is found at the step E02 that the status flag $F_{ZI}$ is not of the "0" state, it is tested at a step E04 whether or not the status flag $F_{ZI}$ is of the "2" state. If it is found that the status flag $F_{ZI}$ is of the "2" state, the step E04 is followed by a step E05 at which the status flag $F_{ZI}$ is shifted to the "0" state and an instruction signal is issued so that the indicators 341a and 341b respectively associated with the switch areas 340a and 340b are turned off in the subsection 306.

If it is found at the step E04 that the status flag $F_{ZI}$ is not of the "2" state, it is tested at a step E06 whether or not the status flag $F_{ZI}$ is of a "3" state. If it is found that the status flag $F_{ZI}$ is of the "3" state, the step E06 is followed by a step E07 at which the status flag $F_{ZI}$ is shifted to the "0" state and an instruction signal is issued so that the indicators 341a to 341d respectively associated with all the switch areas 340a to 340d in the subsection 306 are turned off. If it is found at the step E06 that the status flag $F_{ZI}$ is not of the "3" state, it is tested at a step E08 whether or not the status flag $F_{ZI}$ is of a "4" state. If it is found that the status flag $F_{ZI}$ is of the "4" state, the step E08 is followed by a step E09 at which the status flag $F_{ZI}$ is shifted to the "0" state and an instruction signal is issued so that the indicators 341a to 341d respectively associated with all the switch areas 340a to 340d in the subsection 306 and, in addition, the indicators 345a to 345d for all the switch areas 344a to 344d in the fifth subsection 308 are turned off.

If it is found at the step E08 that the status flag $F_{ZI}$ is not of the "4" state or subsequently to any of the steps E03, E05, E07 and E09, it is tested at a step E10 whether or not the status flag $F_{ZI}$ is of the "2" state. If it is found that the status flag $F_{ZI}$ is of the "2" state, the step E10 is followed by a step E11 at which it is queried whether or not there is present a signal produced with the first switch strip 350a depressed in the touch panel section 124. In the presence of such a signal, an instruction signal is issued at a step E12 so that the indicator 341a associated with the switch area 340a is turned on to flicker and the indicator 341b for the switch area 340b turned off in the fourth subsection 306 of the touch panel section 124. Under these conditions, a magnification ratio is entered from the numerical switches 104. If it is found at the step E11 that there is no signal produced with the first switch strip 350a depressed, it is queried at a step E13 whether or not there is present a signal produced with the second switch strip 350b depressed in the touch panel section 124. In the presence of such a signal, an instruction signal is issued at a step E14 so that the indicator 341a associated with the switch area 340a is turned off and the indicator 341b for the switch area 340b turned on to flicker in the fourth subsection 306 of the touch panel section 124. Under these conditions, the magnification ratio is entered through calculation. Such calculation may be performed through any switches additionally provided on the control panel 100 or any of the existing switches on the control panel 100.

Subsequently to the step E12 or E14, the status flag $F_{ZI}$ is shifted to a "21" state at a step E15, whereupon it is confirmed at a step E16 shown in FIG. 13B whether or not the status flag $F_{ZI}$ is of the "21" state. If it is found that the status flag $F_{ZI}$ is of the "21" state, it is tested at a step E17 whether or not there currently is a magnification ratio entered either from the numerical switches or through calculation. If the answer for this step E17 is given in the affirmative, the step E17 is followed by a step E18 at which the status flag $F_{ZI}$ is shifted to the "3" state and an instruction signal is issued so that only the indicators 341a and 341b respectively associated with the switch areas 340a and 340b are turned off and the indicators 341c and 341d for the switch areas 340c and 340d turned on to flicker in the fourth subsection 306 of the touch panel section 124.

Subsequently to the step E18 or if the answer for the step E16 or E17 is given in the negative, it is tested at a step E19 whether or not the status flag $F_{ZI}$ is of the "3" state. If it is found that the status flag $F_{ZI}$ is of the "3" state, the step E19 is followed by a step E20 at which it is queried whether or not there is present a signal produced with the third switch strip 350c depressed in the touch panel section 124. In the presence of such a signal, an instruction signal is issued at a step E21 so that the indicator 341c associated with the switch area 340c is turned on to flicker and the indicator 341d for the switch area 340*d* turned off in the fourth subsection 306 of the touch panel section 124. Under these conditions, the magnification ratio determined for a single cycle of copying operation is used without being stored into the memory. Such a magnification ratio is, if found necessary, corrected at a step E22 so as to be acceptable for the capabilities of the apparatus and the lens unit 42 is then driven to move to a position to provide the magnification ratio thus corrected. If it is found at the step E20 that there is no signal produced with the third switch strip 350*c* depressed, it is queried at a step E23 whether or not there is present a signal produced with the fourth switch strip 350*d* depressed in the touch panel section 124. In the presence of such a signal, an instruction signal is issued at a step E24 so that the indicator 341*c* associated with the switch area 340*c* is turned off and the indicator 341*d* for the switch area 340*d* turned on to flicker in the fourth subsection 306 of the touch panel section 124. The step E24 is followed by a step E25 at which an instruction signal is issued so that the indicators 345*a* to 345*d* respectively associated with all the switch areas 344*a* to 344*d* are turned on to flicker in the fifth subsection 308 of the touch panel section 124, requesting that the magnification ratio determined from the numerical switches 104 or through calculation be stored into the memory area designated by any of the switch areas 344*a* to 344*d* in the fifth subsection 308.

Subsequently to the step E22 or E25 or if the answer for the step E19 or E23 is given in the negative, it is tested at a step E26 whether or not the status flag $F_{ZI}$ is of the "4" state. If it is found that the status flag $F_{ZI}$ is of the "4" state, it is queried at a step E27 whether or not there is present a signal produced with the first switch strip 350*a* depressed in the touch panel section 124. In the presence of such a signal, the step E27 is followed by a step E28 at which an instruction signal is issued so that only the indicator 345*a* associated with the switch area 344*a* is turned on to flicker with the indicators 345*b* to 345*d* for all the other switch areas 344*b* to 344*d* turned off in the fifth subsection 308 of the touch panel section 124. At this step E28 is further issued an instruction so that the magnification ratio determined is, if found necessary, corrected so as to be acceptable for the capabilities of the apparatus. The step E28 is followed by a step E29 at which an instruction signal is further issued to drive the lens unit 42 for movement to a position providing the magnification ratio thus corrected while memorizing the magnification ratio into the selected memory area and shifting the status flag $F_{ZS}$ to the "0" state.

If it is found at the step E27 that there is no signal produced with the first switch strip 350*a* depressed in the touch panel section 124, it is further tested at a step E30 whether or not there is present a signal produced with the second switch strip 350*b* depressed in the touch panel section 124. In the presence of such a signal, the step E30 is followed by a step E31 at which an instruction signal is issued so that only the indicator 345*b* associated with the switch area 344*b* is turned on to flicker with the indicators 345*a*, 345*c* and 345*d* for the other switch areas 344*a*, 344*c* and 344*d* turned off in the fifth subsection 308 of the touch panel section 124. At this step E31 is further issued an instruction to correct the magnification ratio determined. The step E31 is followed by a step E32 at which an instruction signal is further issued to drive the lens unit 42 for movement to a position providing the corrected magnification ratio while memorizing the magnification ratio into the selected memory area and shifting the status flag $F_{ZS}$ to the "0" state.

If it is found at the step E30 that there is no signal produced with the second switch strip 350*b* depressed in the touch panel section 124, it is further tested at a step E33 whether or not there is present a signal produced with the third switch strip 350*c* depressed in the touch panel section 124. In the presence of such a signal, the step E33 is followed by a step E34 at which an instruction signal is issued so that only the indicator 345*c* associated with the switch area 344*c* is turned on to flicker in the fifth subsection 308 of the touch panel section 124. At this step E34 is further issued an instruction to correct the magnification ratio determined. The step E34 is followed by a step E35 at which an instruction signal is further issued to drive the lens unit 42 for movement to a position providing the corrected magnification ratio while memorizing the magnification ratio into the selected memory area and shifting the status flag $F_{ZS}$ to the "0" state. If it is found at the step E33 that there is no signal produced with the second switch strip 350*c* depressed, it is further tested at a step E36 whether or not there is present a signal produced with the fourth switch strip 350*d* depressed. In the presence of such a signal, the step E36 is followed by a step E37 at which an instruction signal is issued so that only the indicator 345*d* associated with the switch area 344*d* is turned on to flicker. At this step E37 is further issued an instruction to correct the magnification ratio determined, whereupon an instruction signal is issued at a step E38 to drive the lens unit 42 for movement to a position providing the corrected magnification ratio while memorizing the magnification ratio into the selected memory area and shifting the status flag $F_{ZS}$ to the "0" state. If it is found at the step E36 that there is no signal produced with the fourth switch strip 350*d* depressed in the touch panel section 124 or subsequently to any of the steps E29, E32, E55 and E38, the system recycles the subroutine program.

FIG. 14 shows the details of the copy-area editing subroutine program A07 further included in the main routine program illustrated in FIG. 9. The copy-area editing subroutine program A07 starts with a decision step F01 at which it is queried whether or not there is a signal produced with the edited copy mode select switch 310 depressed. In the presence of such a signal, an instruction signal is issued at a step F02 to turn off all the indicators 118*a* associated with the color select switch 118 and enable entry of signals to build up an area in the area display screen 314. Subsequently to this step F02 or if it is found at the step F01 that an edited mode of copying operation is not currently selected, it is confirmed at a step F03 whether or not entry of the x-coordinates $X_1$ and $X_2$ and y-coordinates $Y_1$ and $Y_2$ for the desired edited copy/erase area 1 is complete. If the answer for this step F03 is given in the affirmative, it is further queries at a step F04 whether or not the upper developing unit 54*a* is installed within the apparatus. If the developing unit 54*a* is found to be installed in the apparatus, an instruction signal is issued at a step F05 by which the indicators 118*a* and 118*b* allocated to the developing units 54*a* and 54*b* storing the black and red colored toners are turned on to flicker. The step F05 is followed by a step F06 by which an instruction signal is further issued so that the indicators 325*a*, 325*b* and 325*c* respectively associated with the black select switch 324*a*, area color switch 324*b* and area erase switch 324*c* are turned on to flicker. If it is found at the step F04 that the upper developing unit 54a is currently not installed within the apparatus, then an instruction signal is issued at a step F07 by which the indicator 118a allocated to the developing unit 54a storing the black colored toner is turned on to flicker. The step F07 is followed by a step F08 by which an instruction signal is further issued so that the indicators 325a and 325c respectively associated with the black select switch 324a and area erase switch 324c are turned on to flicker. The operator will then depress any one of the switches 324a, 324b and 324c so that, subsequently to the step F06 or step F08, an instruction signal is issued at a step F09 by which the indicator associated with the depressed one of the switches 324a, 324b and 324c is permitted to illuminate continuously.

Figure 14B:
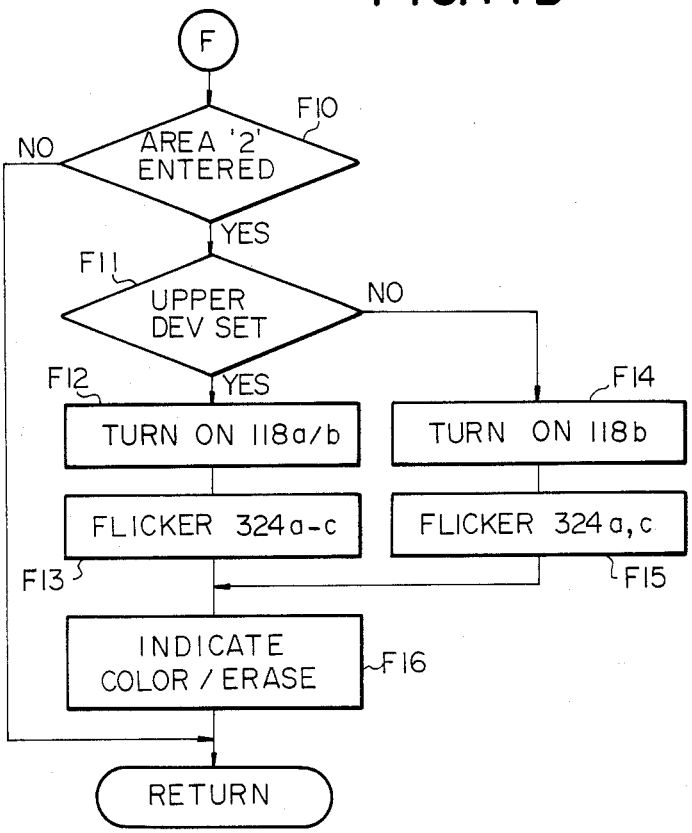

Subsequently to the step F09 or if it is found at the step F03 that the entry of the x- and y-coordinates specifying the desired edited copy/erase area 1 is still incomplete, it is confirmed at a step F10 shown in FIG. 14B whether or not entry of the x-coordinates $X_1$ and $X_2$ and y-coordinates $Y_1$ and $Y_2$ for the desired edited copy/erase area 2 is complete. If the answer for this step F10 is given in the affirmative, it is further queries at a step F11 whether or not the upper developing unit 54a is installed within the apparatus. If the developing unit 54a is found to be installed in the apparatus, an instruction signal is issued at a step F12 by which the indicators 118a and 118b allocated to the developing units 54a and 54b storing the black and red colored toners are turned on to flicker. The step F12 is followed by a step F13 by which an instruction signal is further issued so that the indicators 325a, 325b and 325c respectively associated with the black select switch 324a, area color switch 324b and area erase switch 324c are turned on to flicker. If it is found at the step F11 that the upper developing unit 54a is currently not installed within the apparatus, then an instruction signal is issued at a step F14 by which the indicator 118a allocated to the developing unit 54a storing the black colored toner is turned on to flicker. The step F14 is followed by a step F15 which an instruction signal is further issued so that the indicators 325a and 325c respectively associated with the black select switch 324a and area erase switch 324c are turned on to flicker. The operator will then depress any one of the switches 324a, 324b and 324c so that, subsequently to the step F13 or step F15, an instruction signal is issued at a step F16 by which the indicator associated with the depressed one of the switches 324a, 324b and 324c is permitted to illuminate continuously. Subsequently to the step F16 or if it is found at the step F10 that the entry of the x- and y-coordinates specifying the desired edited copy/erase area 1 is still incomplete, the system returns to the step F01.

Figure 15A:
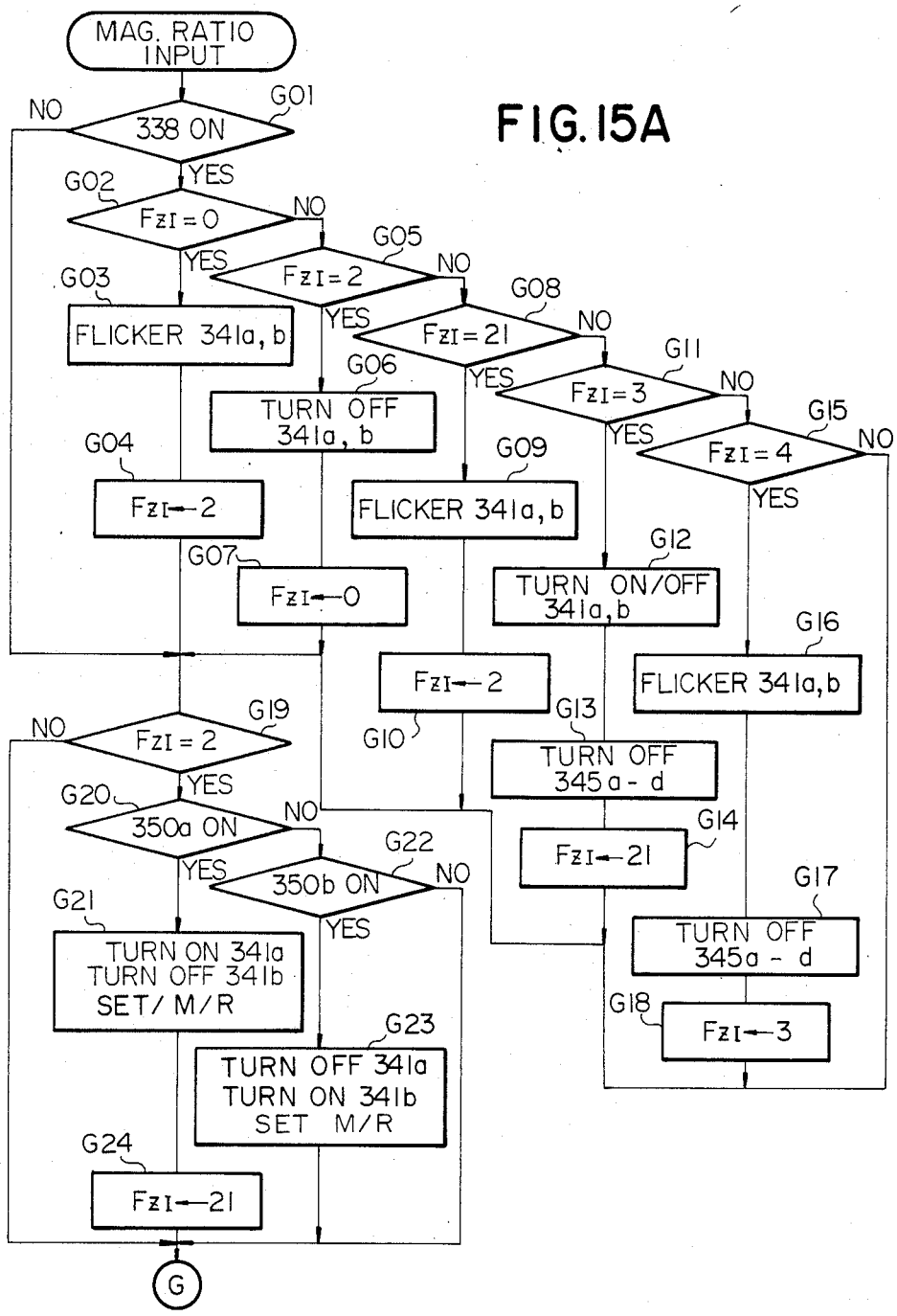
FIGS. 15A and 15B are flowcharts showing a modification of the zoomed magnification ratio input mode select subroutine program illustrated in FIGS. 13A to 13C.
Figure 15B:
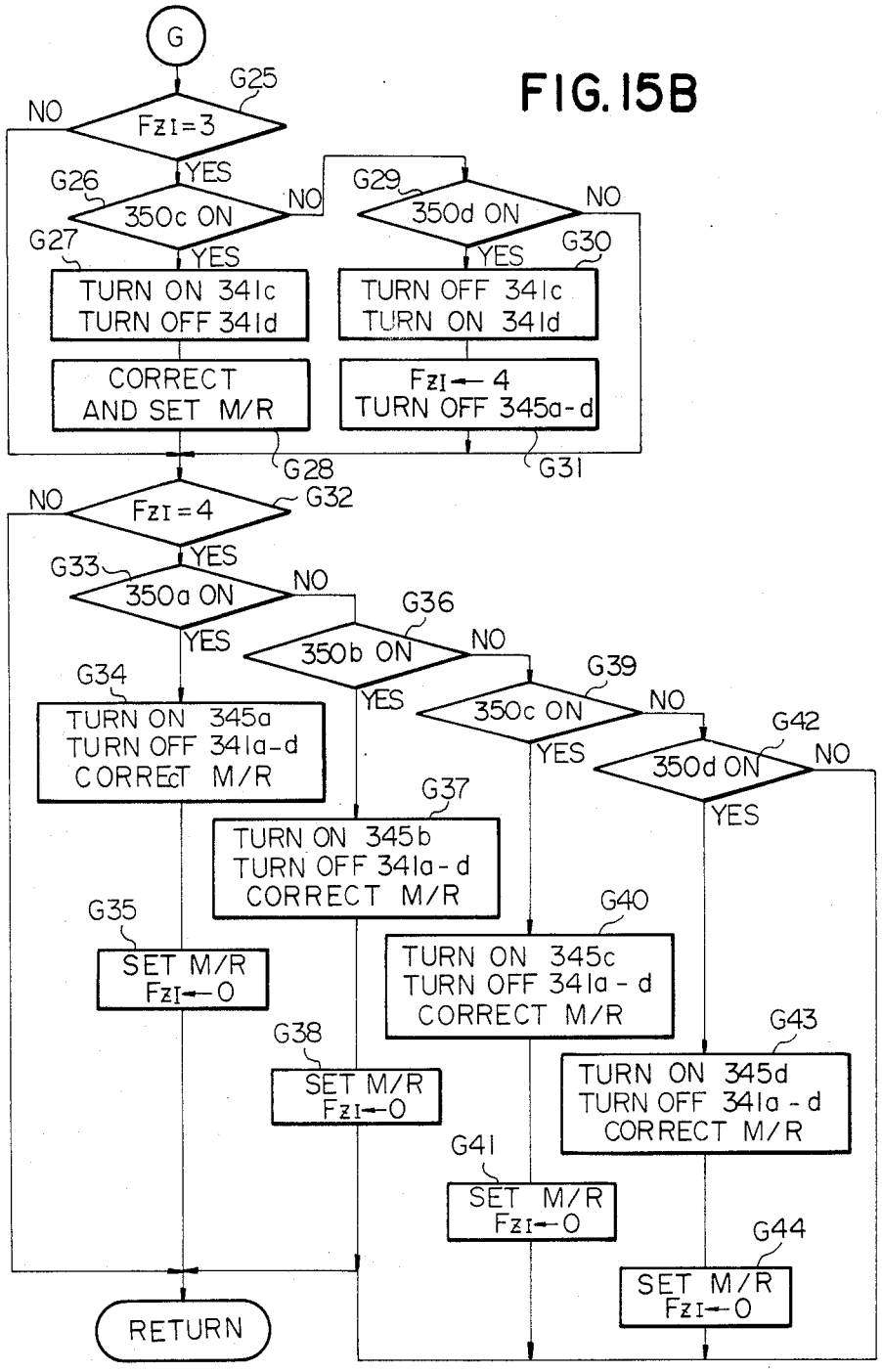

FIGS. 15A and 15B show a modification of the zoomed magnification ratio input mode select subroutine program A06 described with reference to FIGS. 13A to 13C. The modified subroutine program herein shown starts with a decision step G01 at which it is queried whether or not there is present a signal produced with the zoomed magnification ratio input mode select switch 338 depressed in the touch panel section 124. In the presence of such a signal, it is further tested at a step G02 whether or not the status flag $F_{ZI}$ is of a "0" state. If it is found that the status flag $F_{ZI}$ is of the "0" state, the step G02 is followed by a step G03 at which an instruction signal is issued so that the indicators 341a and 341b respectively associated with the switch areas 340a and 340b are turned on to flicker in the fourth subsection 306 of the touch panel section 124. At a subsequent step G04, the status flag $F_{ZI}$ is shifted to a "2" state so that a magnification ratio may be entered either from the numerical switches 104 or through calculation. If it is found at the step G02 that the status flag $F_{ZI}$ is not of the "0" state, it is tested at a step G05 whether or not the status flag $F_{ZI}$ is of the "2" state. If it is found that the status flag $F_{ZI}$ is of the "2" state, the step G05 is followed by a step G06 at which an instruction signal is issued so that the indicators 341a and 341b respectively associated with the switch areas 340a and 340b are turned off in the subsection 306. The status flag $F_{ZI}$ is shifted to the "0" state at a subsequent step G07.

If it is found at the step G05 that the status flag $F_{ZI}$ is not of the "2" state, it is tested at a step G08 whether or not the status flag $F_{ZI}$ is of a "21" state. If it is found that the status flag $F_{ZI}$ is of the "21" state, the step G08 is followed by a step G07 at which an instruction signal is issued so that the indicators 341a and 341b respectively associated with the switch areas 340a and 340b in the subsection 306 are turned on to flicker. The status flag $F_{ZI}$ is shifted to the "2" state at a subsequent step G10. If it is found at the step G08 that the status flag $F_{ZI}$ is not of the "21" state, it is tested at a step G11 whether or not the status flag $F_{ZI}$ is of a "3" state. If it is found that the status flag $F_{ZI}$ is of the "3" state, the step G11 is followed by a step G12 at which an instruction signal is issued so that the immediate preceding condition having the status flag $F_{ZI}$ of the "21" state is restored and each of the indicators 341a and 341b respectively associated with the switch areas 340a and 340b in the subsection 306 is turned on or off. At subsequent steps G13 and G14, the indicators 341c and 341d respectively associated with the switch areas 340c and 340d in the subsection 306 are turned off and the status flag $F_{ZI}$ is shifted to the "21" state.

If it is found at the step G11 that the status flag $F_{ZI}$ is not of the "3" state, it is tested at a step G15 whether or not the status flag $F_{ZI}$ is of a "4" state. If it is found that the status flag $F_{ZI}$ is of the "4" state, the step G15 is followed by a step G16 at which an instruction signal is issued so that the indicators 341c and 341d respectively associated with the switch areas 340c and 340d in the subsection 306 are turned on to flicker. Subsequently, an instruction signal is issued at a step G17 so that the indicators 345c to 345d respectively associated with all the switch areas 344a to 344d in the fifth subsection 308 are turned off and, further at a subsequent step G18, the status flag $F_{ZI}$ is shifted to the "3" state.

If it is found at the step G08 that the status flag $F_{ZI}$ is not of the "4" state or subsequently to any of the steps G04, G07, G10, G14 and G18, it is tested at a step G19 whether or not the status flag $F_{ZI}$ is of the "2" state. If it is found that the status flag $F_{ZI}$ is of the "2" state, the step G19 is followed by a step G20 at which it is queried whether or not there is present a signal produced with the first switch strip 350a depressed in the touch panel section 124. In the presence of such a signal, an instruction signal is issued at a step G21 so that the indicator 341a associated with the switch area 340a is turned on to flicker and the indicator 341b for the switch area 340b turned off in the fourth subsection 306 of the touch panel section 124. Under these conditions, a magnification ratio is entered from the numerical switches 104. If it is found at the step G20 that there is no signal produced with the first switch strip 350a depressed, it is queried at a step G22 whether or not there is present a signal produced with the second switch strip 350b depressed in the touch panel section 124. In the presence of such a signal, an instruction signal is issued at a step G23 so that the indicator 341*a* associated with the switch area 340*a* is turned off and the indicator 341*b* for the switch area 340*b* turned on to flicker in the fourth subsection 306 of the touch panel section 124. Under these conditions, the magnification ratio is entered through calculation. Such calculation may be performed through any switches additionally provided on the control panel 100 or any of the existing switches on the control panel 100.

Subsequently to the step G21 or G23, the status flag $F_{ZI}$ is shifted to a "21" state at a step G24, whereupon it is confirmed at a step G25 shown in FIG. 15B whether or not the status flag $F_{ZI}$ is of the "3" state. If it is found that the status flag $F_{ZI}$ is of the "3" state, the step G25 is followed by a step G26 at which it is queried whether or not there is present a signal produced with the third switch strip 350*c* depressed in the touch panel section 124. In the presence of such a signal, an instruction signal is issued at a step G27 so that the indicator 341*c* associated with the switch area 340*c* is turned on to flicker and the indicator 341*d* for the switch area 340*d* turned off in the fourth subsection 306 of the touch panel section 124. Under these conditions, the magnification ratio determined for a single cycle of copying operation is used without being stored into the memory. Such a magnification ratio is, if found necessary, corrected at a step G24 so as to be acceptable for the capabilities of the apparatus and the lens unit 42 is then driven to move to a position to provide the magnification ratio thus corrected. If it is found at the step G26 that there is no signal produced with the third switch strip 350*c* depressed, it is queried at a step G29 whether or not there is present a signal produced with the fourth switch strip 350*d* depressed in the touch panel section 124. In the presence of such a signal, an instruction signal is issued at a step G30 so that the indicator 341*c* associated with the switch area 340*c* is turned off and the indicator 341*d* for the switch area 340*d* turned on to flicker in the fourth subsection 306 of the touch panel section 124. The step G30 is followed by a step G31 at which an instruction signal is issued so that the indicators 345*a* to 345*d* respectively associated with all the switch areas 344*a* to 344*d* are turned on to flicker in the fifth subsection 308 of the touch panel section 124, requesting that the magnification ratio determined from the numerical switches 104 or through calculation be stored into the memory area designated by any of the switch areas 344*a* to 344*d* in the fifth subsection 308.

Subsequently to the step G28 or G31 or if the answer for the step G25 or G29 is given in the negative, it is tested at a step G32 whether or not the status flag $F_{ZI}$ is of the "4" state. If it is found that the status flag $F_{ZI}$ is of the "4" state, it is queried at a step G33 whether or not there is present a signal produced with the first switch strip 350*a* depressed in the touch panel section 124. In the presence of such a signal, the step G33 is followed by a step G34 at which an instruction signal is issued so that only the indicator 345*a* associated with the switch area 344*a* is turned on to flicker with the indicators 345*b* to 345*d* for all the other switch areas 344*b* to 344*d* turned off in the fifth subsection 308 of the touch panel section 124. At this step G34 is further issued an instruction so that the magnification ratio determined is, if found necessary, corrected so as to be acceptable for the capabilities of the apparatus. The step G34 is followed by a step G35 at which an instruction signal is further issued to drive the lens unit 42 for movement to a position providing the magnification ratio thus corrected while memorizing the magnification ratio into the selected memory area and shifting the status flag $F_{ZS}$ to the "0" state.

If it is found at the step G33 that there is no signal produced with the first switch strip 350*a* depressed in the touch panel section 124, it is further tested at a step G36 whether or not there is present a signal produced with the second switch strip 350*b* depressed in the touch panel section 124. In the presence of such a signal, the step G36 is followed by a step G37 at which an instruction signal is issued so that only the indicator 345*b* associated with the switch area 344*b* is turned on to flicker with the indicators 345*a*, 345*c* and 345*d* for the other switch areas 344*a*, 344*c* and 344*d* turned off in the fifth subsection 308 of the touch panel section 124. At this step G37 is further issued an instruction to correct the magnification ratio determined. The step G37 is followed by a step G38 at which an instruction signal is further issued to drive the lens unit 42 for movement to a position providing the corrected magnification ratio while memorizing the magnification ratio into the selected memory area and shifting the status flag $F_{ZS}$ to the "0" state.

If it is found at the step G36 that there is no signal produced with the second switch strip 350*b* depressed in the touch panel section 124, it is further tested at a step G39 whether or not there is present a signal produced with the third switch strip 350*c* depressed in the touch panel section 124. In the presence of such a signal, the step G39 is followed by a step G40 at which an instruction signal is issued so that only the indicator 345*c* associated with the switch area 344*c* is turned on to flicker in the fifth subsection 308 of the touch panel section 124. At this step G40 is further issued an instruction to correct the magnification ratio determined. The step G40 is followed by a step G41 at which an instruction signal is further issued to drive the lens unit 42 for movement to a position providing the corrected magnification ratio while memorizing the magnification ratio into the selected memory area and shifting the status flag $F_{ZS}$ to the "0" state. If it is found at the step G39 that there is no signal produced with the second switch strip 350*c* depressed, it is further tested at a step G42 whether or not there is present a signal produced with the fourth switch strip 350*d* depressed. In the presence of such a signal, the step G42 is followed by a step G43 at which an instruction signal is issued so that only the indicator 345*d* associated with the switch area 344*d* is turned on to flicker. At this step E43 is further issued an instruction to correct the magnification ratio determined, whereupon an instruction signal is issued at a step G44 to drive the lens unit 42 for movement to a position providing the corrected magnification ratio while memorizing the magnification ratio into the selected memory area and shifting the status flag $F_{ZS}$ to the "0" state. If it is found at the step G42 that there is no signal produced with the fourth switch strip 350*d* depressed in the touch panel section 124 or subsequently to any of the steps G35, G38, G41 and G44, the system recycles the subroutine program.

What is claimed is:

1. A multiple-mode image duplicating apparatus having a plurality of groups of modes of operation, comprising (a) image reproducing means, (b) first selecting means for selecting a single group of modes out of said plurality of groups of modes of operation, (c) second selecting means for selecting a single mode of operation from the group of modes selected by said first selecting means, and (d) control means for controlling said image reproducing means to operate for the mode of operation specified by said first and second selecting means.

2. A multiple-mode image duplicating apparatus as set forth in claim 1, further comprising display means for displaying the modes of operation included in the group of modes selected by said first selecting means.

3. A multiple-mode image duplicating apparatus as set forth in claim 2, in which said display means is operative to display only the mode of operation selected by said second selecting means when a mode of operation is selected by the second selecting means from the group of modes selected by said first selecting means.

4. A multiple-mode image duplicating apparatus as set forth in claim 2, in which said display means is operative to display in one manner the modes of operation included in the group of modes selected by said first selecting means and in another manner the mode of operation selected by said second selecting means when said single mode of operation is selected by the second selecting means from the group of modes selected by said first selecting means.

5. A multiple-mode image duplicating apparatus as set forth in claim 1, further comprising a print start switch and disabling means for disabling said print start switch after a group of modes is selected out of said plurality of groups of modes of operation by said first selecting means and until a mode of operation is selected by said second selecting means from the group of modes selected by said first selecting means.

6. An operation mode setup system for an image duplicating apparatus having a plurality of groups of modes of operation, comprising (a) first selecting means for selecting a single group of modes out of said plurality of groups of modes of operation, (b) second selecting means for selecting a single mode of operation from the group of modes selected by said first selecting means, and (d) mode setup means by which the mode of operation selected by said second selecting means from the group of modes selected by said first selecting means is established as the mode of operation to be executed by said duplicating apparatus.

7. An operation mode setup system as set forth in claim 6, further comprising display means for displaying the modes of operation included in the group of modes selected by said first selecting means.

8. An operation mode setup system as set forth in claim 7, in which said display means is operative to display only the mode of operation selected by said second selecting means when a mode of operation is selected by the second selecting means from the group of modes selected by said first selecting means.

9. An operation mode setup system as set forth in claim 7, in which said display means is operative to display in one manner the modes of operation included in the group of modes selected by said first selecting means and in another manner the mode of operation selected by said second selecting means when said single mode of operation is selected by the second selecting means from the group of modes selected by said first selecting means.

10. An image duplicating apparatus having a plurality of groups of modes of operation, comprising (a) image reproducing means, (b) first input switch means, (c) first control means responsive to operation of said first input switch means for selecting a single group of modes out of said plurality of groups of modes of operation, (d) second input switch means, (e) second control means responsive to operation of said second input switch means for selecting a single mode of operation from the group of modes selected by said first control means, (f) third control means responsive to operation of said second input switch means after a mode of operation is selected by the second control means for selecting a single condition out of a plurality of different conditions available for the selected mode of operation, and (g) fourth control means for controlling said image reproducing means to operate for the mode of operation selected by said first and second control means and the condition selected by said third control means.

11. An image duplicating apparatus as set forth in claim 10, further comprising display means for displaying the modes of operation included in the group of modes selected by said first control means.

12. An image duplicating apparatus as set forth in claim 11, in which said display means is operative to display only the mode of operation selected by said second control means when a mode of operation is selected by the second control means from the group of modes selected by said first control means.

13. An image duplicating apparatus as set forth in claim 12, in which said display means is operative to display the conditions available for the mode of operation selected by said second control means when a mode of operation is selected by said second control means.

14. An image duplicating apparatus as set forth in claim 13, in which said display means is operative to display only the condition selected by said third control means when one of said conditions available for the mode of operation selected by said second control means is selected by said third control means.

15. An image duplicating apparatus as set forth in claim 12, in which said display means is operative to display in one manner the modes of operation included in the group of modes selected by said first control means and in another manner the mode of operation selected by said second control means when said single mode of operation is selected by the second control means from the group of modes selected by said first control means.

16. An image duplicating apparatus as set forth in claim 13, in which said display means is operative to display in one manner the conditions available for the mode of operation selected by said second control means and in another manner the condition selected by said third control means when said single of said conditions is selected by the third control means.

17. An image duplicating apparatus as set forth in claim 10, further comprising a print start switch and disabling means for disabling said print start switch after a group of modes is selected out of said plurality of groups of modes of operation by said first control means and until one of said conditions is selected by the third control means.

18. An operation mode setup system for an image duplicating apparatus having a plurality of groups of modes of operation, comprising (a) first input switch means, (b) first control means responsive to operation of said first input switch means for selecting a single group of modes out of said plurality of groups of modes of operation, (c) second input switch means, (d) second control means responsive to operation of said second input switch means for selecting a single mode of operation from the group of modes selected by said first control means, (e) third control means responsive to operation of said second input switch means after a mode of operation is selected by the second control means for selecting a single condition out of a plurality of different conditions available for the selected mode of operation, and (f) fourth control means by which the mode of operation selected by said second control means from the group of modes selected by said first selecting means and the condition selected by said third control means from the conditions available for the selected mode of operation are established as those which are to be executed by said apparatus.

19. An operation mode setup system as set forth in claim 18, further comprising display means for displaying the modes of operation included in the group of modes selected by said first control means.

20. An operation mode setup system as set forth in claim 19, in which said display means is operative to display only the mode of operation selected by said second control means when a mode of operation is selected by the second control means from the group of modes selected by said first control means.

21. An operation mode setup system as set forth in claim 20, in which said display means is operative to display the conditions available for the mode of operation selected by said second control means when a mode of operation is selected by said second control means.

22. An operation mode setup system as set forth in claim 21, in which said display means is operative to display only the condition selected by said third control means when one of said conditions available for the mode of operation selected by said second control means is selected by said third control means.

23. An operation mode setup system as set forth in claim 20, in which said display means is operative to display in one manner the modes of operation included in the group of modes selected by said first control means and in another manner the mode of operation selected by said second control means when one mode of operation is selected by the second control means from the group of modes selected by said first control means.

24. An operation mode setup system as set forth in claim 21, in which said display means is operative to display in one manner the conditions available for the mode of operation selected by said second control means and in another manner the condition selected by said third control means when one of said conditions is selected by the third control means.

25. An image duplicating apparatus having a plurality of modes of operation, comprising (a) image reproducing means, (b) input switch means, (c) first control means responsive to operation of said input switch means for selecting a single mode of operation from said plurality of modes of operation, (d) second control means responsive to operation of said input switch means after a mode of operation is selected by said first control means for selecting a single condition out of a plurality of different conditions available for the selected mode of operation, and (e) third control means for controlling said image reproducing means to operate for the mode of operation selected by said first control means and the condition selected by said third control means.

26. An operation mode setup system for an image duplicating apparatus having a plurality of modes of operation, comprising (a) input switch means, (b) first control means responsive to operation of said input switch means for selecting a single mode of operation from said plurality of modes of operation, (c) second control means responsive to operation of said input switch means after a mode of operation is selected by said first control means for selecting a single condition out of a plurality of different conditions available for the selected mode of operation, and (d) mode setup means by which the mode of operation selected by said first control means from said plurality of modes of operation and the condition selected by said second control means from the conditions available for the selected mode of operation are stablished as those which are to be executed by said apparatus.

27. An image duplicating apparatus having a plurality of modes of operation including a magnification/reduction ratio select mode, comprising (a) image reproducing means having a plurality of magnification/reduction ratios for copying, (b) first input switch means, (c) second input switch means, (d) first control means responsive to operation of said first input switch means for selecting said magnification/reduction ratio select mode from said plurality of modes of operation, (e) second control means responsive to operation of said second input switch means when said magnification/reduction ratio select mode is selected by said first control means for selecting one of said plurality of magnification/reduction ratios for copying, and (f) third control means which, when said magnification/reduction ratio select mode is selected by said first control means, is operative to cancel said magnification/reduction ratio select mode and in turn select a predetermined magnification/reduction ratio for copying, if said first input switch means is operated before one of said plurality of magnification/reduction ratios for copying is selected by said second control means.

28. An image duplicating apparatus as set forth in claim 27, in which said second control means is operative to cancel said magnification/reduction ratio select mode while selecting one of said plurality of magnification/reduction ratios for copying in response to operation of said second input switch means.

29. An image duplicating apparatus as set forth in claim 27, in which said predetermined magnification/reduction ratio is a one-to-one ratio.

30. An image duplicating apparatus having a plurality of modes of operation including a magnification/reduction ratio select mode, comprising (a) image reproducing means having a plurality of magnification/reduction ratios for copying, (b) magnification/reduction ratio selecting means for selecting one of said plurality of magnification/reduction ratios, (c) operation mode setup means operative to establish and cancel an enabling mode of operation enabling said magnification/reduction ratio selecting means to select one of said plurality of magnification/reduction ratios, and (d) control means operative to select a predetermined magnification/reduction ratio for copying, when said enabling mode of operation is cancelled by said operation mode setup means before one of said plurality of magnification/reduction ratios is selected by said magnification/reduction ratio selecting means.

31. An image duplicating apparatus having a plurality of groups of modes of operation, comprising (a) image reproducing means, (b) first input switch means, (c) first control means responsive to operation of said first input switch means for selecting a single group of modes out of said plurality of groups of modes of operation, (d) second input switch means, (e) second control means responsive to operation of said second input switch means for selecting a single mode of operation from the group of modes selected by said first control means, (f) third control means responsive to operation of said second input switch means after said single group of modes is selected by the first control means, for selecting a predetermined mode of operation from the group of modes selected by said first control means, and (g) fourth control means for controlling said image reproducing means to operate for the mode of operation selected by one of said second and third control means.

32. A copying function selecting system for an image duplicating apparatus having a plurality of modes of operation each including a plurality of functions, comprising (a) display means having a plurality of display sections respectively allocated to said plurality of modes of operation and each including a plurality of display areas arranged in rows and columns and each visually indicating each of the functions included in the mode of operation to which the display section is allocated, (b) a plurality of mode selecting means each provided within each of said display sections for allowing selection of the mode of operation to which the display section is allocated, (c) a plurality of function selecting means extending through each of the rows of display areas of the plurality of display sections, each of said function selecting means allowing selection of the functions indicated by the display areas of the row through which the function selecting means extends, and (d) copying condition setup means by which the function selected by said function selecting means out of the functions included in the mode of operation selected by said mode selecting means is established as the mode of operation to be executed by said duplicating apparatus.

33. A copying function selecting system as set forth in claim 32, in which each of said function selecting means comprises a flexible transparent strip.

34. A copying function selecting system for an image duplicating apparatus having a plurality of modes of operation each including a plurality of functions, comprising (a) display means having a plurality of display sections respectively allocated to said plurality of modes of operation and each including a plurality of display areas arranged in rows and columns and each visually indicating each of the functions included in the mode of operation to which the display section is allocated, at least one of said display sections including two groups of display areas wherein the functions respectively indicated by the display areas of one of the groups being to be established posterior to the functions respectively indicated by the display areas of the other of the groups, (b) a plurality of mode selecting means each provided within each of said display sections for allowing selection of the mode of operation to which the display section is allocated, (c) a plurality of function selecting means extending through each of the rows of display areas of the plurality of display sections, each of said function selecting means allowing selection of the functions indicated by the display areas of the row through which the function selecting means extends, and (d) copying condition setup means by which the function selected by said function selecting means out of the functions included in the mode of operation selected by said mode selecting means is established as the mode of operation to be executed by said duplicating apparatus wherein, when the mode of operation to which the display section including the two groups of display areas is allocated is selected by said mode selecting means, one of the functions respectively indicated by the display areas of one of the groups is established posterior to one of the functions respectively indicated by the display areas of the other of the groups.

35. A copying function selecting system as set forth in claim 34, in which each of said function selecting means comprises a flexible transparent strip.

36. A copying function selecting system for an image duplicating apparatus having a plurality of modes of operation each including a plurality of functions, comprising (a) display means having a plurality of display sections respectively allocated to said plurality of modes of operation and each including a plurality of display areas arranged in rows and columns and each visually indicating each of the functions included in the mode of operation to which the display section is allocated, at least one of said display sections including first and second groups of display areas wherein the functions respectively indicated by the display areas of the second group being subsidiary to the functions respectively indicated by the display areas of the first group, (b) a plurality of mode selecting means each provided within each of said display sections for allowing selection of the mode of operation to which the display section is allocated, (c) a plurality of function selecting means extending through each of the rows of display areas of the plurality of display sections, each of said function selecting means allowing selection of the functions indicated by the display areas of the row through which the function selecting means extends, and (d) copying condition setup means by which the function selected by said function selecting means out of the functions included in the mode of operation selected by said mode selecting means is established as the mode of operation to be executed by said duplicating apparatus wherein, when the mode of operation to which the display section including the first and second groups of display areas is allocated is selected by said mode selecting means, one of the functions respectively indicated by the display areas of the second group is established posterior to one of the functions respectively indicated by the display areas of the first group.

37. A copying function selecting system as set forth in claim 36, in which each of said function selecting means comprises a flexible transparent strip.

38. A copying function selecting system as set forth in claim 36, further comprising a print start switch and disabling means for disabling said print start switch such that, when the mode of operation to which the display section including the first and second groups of display areas is allocated is selected by said mode selecting means, said disabling means disables said print start after one of the functions respectively indicated by the display areas of the first group is established and until one of the functions respectively indicated by the display areas of the second group is established.

39. A copying function selecting system for an image duplicating apparatus having a plurality of modes of operation each including a plurality of functions, comprising (a) display means having a plurality of display sections respectively allocated to said plurality of modes of operation and each including a plurality of display areas arranged in rows and columns and each visually indicating each of the functions included in the mode of operation to which the display section is allocated, (b) visible illuminating means having a continuously illuminating condition, a flickering condition and a turned-off condition and each provided in association with each of said display areas, (c) a plurality of mode selecting means each provided within each of said display sections for allowing selection of the mode of operation to which the display section is allocated, (d) a plurality of function selecting means extending through each of the rows of display areas of the plurality of display sections, each of said function selecting means allowing selection of the functions indicated by the display areas of the row through which the function selecting means extends, and (e) copying condition setup means by which the function selected by said function selecting means out of the functions included in the mode of operation selected by said mode selecting means is established as the mode of operation to be executed by said duplicating apparatus, (f) wherein each of the illuminating means respectively associated with the display areas included in each of said display sections has said flickering condition when the mode of operation to which the display section is allocated is selected by said mode selecting means.

40. A copying function selecting system as set forth in claim 39, in which, while each of the illuminating means respectively associated with the display areas included in each of said display sections has said flickering condition, the illuminating means associated with each of the other display areas included in the display section allocated to the mode of operation selected by said mode selecting means has said turned-off condition.

41. A copying function selecting system for an image duplicating apparatus having a plurality of modes of operation each including a plurality of functions, comprising (a) display means having a plurality of display sections respectively allocated to said plurality of modes of operation and each including a plurality of display areas arranged in rows and columns and each visually indicating each of the functions included in the mode of operation to which the display section is allocated, at least one of said display sections including first and second groups of display areas wherein the functions respectively indicated by the display areas of the second group being subsidiary to the functions respectively indicated by the display areas of the first group, (b) visible illuminating means having a continuously illuminating condition, a flickering condition and a turned-off condition and each provided in association with each of said display areas, (c) a plurality of mode selecting means each provided within each of said display sections for allowing selection of the mode of operation to which the display section is allocated, (d) a plurality of function selecting means extending through each of the rows of display areas of the plurality of display sections, each of said function selecting means allowing selection of the functions indicated by the display areas of the row through which the function selecting means extends, and (e) copying condition setup means by which the function selected by said function selecting means out of the functions included in the mode of operation selected by said mode selecting means is established as the mode of operation to be executed by said duplicating apparatus wherein, when the mode of operation to which the display section including the first and second groups of display areas is allocated is selected by said mode selecting means, one of the functions respectively indicated by the display areas of the second group is established posterior to one of the functions respectively indicated by the display areas of the first group, (f) wherein each of the illuminating means respectively associated with the display areas included in each of said display sections has said flickering condition when the mode of operation to which the display section is allocated is selected by said mode selecting means, whereupon each of the illuminating means respectively associated with the display areas included in each of said display sections has said illuminating condition when the function to which the display area is selected by said function selecting means while each of the illuminating means associated with each of the other display areas included in the display section allocated to the mode of operation selected by said mode selecting means has said turned-off condition, and (g) wherein, when the mode of operation to which the display section including the first and second groups of display areas is allocated is selected by said mode selecting means, each of the illuminating means respectively associated with the display areas included in the display section has said flickering condition when the mode of operation to which the display section is allocated is selected by said mode selecting means whereupon, when one of the functions respectively indicated by the display areas of the first group is established, the illuminating means associated with the display area allocated to the selected function has said illuminating condition with each of the illuminating means for the other display areas brought into the turned-off condition and thereafter each of the illuminating means respectively associated with the display areas of the second group has said flickering condition until one of the functions to which these display areas is selected by said function selecting means.

42. A copying function selecting system as set forth in claim 41, in which at least one of the display areas of the first group has no subsidiary display area in the second group of display areas, wherein none of the illuminating means respectively associated with the display areas of the second group is brought into the flickering condition when the function allocated to the display area of the first group which has no subsidiary display area in the second group of display areas is selected by said function selecting means.

43. A copying function selecting system as set forth in claim 41, further comprising a print start switch and disabling means for disabling said print start switch such that, when the mode of operation to which the display section including the first and second groups of display areas is allocated is selected by said mode selecting means, said disabling means disables said print start after one of the functions respectively indicated by the display areas of the first group is established and until one of the functions respectively indicated by the display areas of the second group is established.

44. A copying function selecting system for an image duplicating apparatus having a plurality of modes of operation each including a plurality of functions, comprising (a) display means having a plurality of display sections respectively allocated to said plurality of modes of operation and each including a plurality of display areas arranged in rows and columns and each visually indicating each of the functions included in the mode of operation to which the display section is allocated, (b) a plurality of mode selecting means each provided within each of said display sections for allowing selection of the mode of operation to which the display section is allocated, (c) a plurality of function selecting means extending through each of the rows of display areas of the plurality of display sections, each of said function selecting means comprising a flexible transparent strip and allowing selection of the functions indicated by the display areas of the row through which the function selecting means extends, (d) copying condition setup means by which the function selected by said function selecting means out of the functions included in the mode of operation selected by said mode selecting means is established as the mode of operation to be executed by said duplicating apparatus, and (e) optional function indication means located adjacent said display means in proximity to said plurality of function selecting means for allowing the user to provide indication of desired optional functions cognant to said plurality of functions.

45. A copying function selecting system for an image duplicating apparatus having a plurality of modes of operation each including a plurality of functions, comprising (a) display means having a plurality of display sections respectively allocated to said plurality of modes of operation and each including a plurality of display areas arranged in rows and columns and each visually indicating each of the functions included in the mode of operation to which the display section is allocated, at least one of said display sections including first and second groups of display areas wherein the functions respectively indicated by the display areas of the second group being subsidiary to the functions respectively indicated by the display areas of the first group, said first and second groups of display areas being arranged in said columns, (b) visible illuminating means having a continuously illuminating condition, a flickering condition and a turned-off condition and each provided in association with each of said display areas, (c) a plurality of mode selecting means each provided within each of said display sections for allowing selection of the mode of operation to which the display section is allocated, (d) a plurality of function selecting means extending through each of the rows of display areas of the plurality of display sections, each of said function selecting means allowing selection of the functions indicated by the display areas of the row through which the function selecting means extends, and (e) copying condition setup means by which the function selected by said function selecting means out of the functions included in the mode of operation selected by said mode selecting means is established as the mode of operation to be executed by said duplicating apparatus wherein, when the mode of operation to which the display section including the first and second groups of display areas is allocated is selected by said mode selecting means, one of the functions respectively indicated by the display areas of the second group is established posterior to one of the functions respectively indicated by the display areas of the first group, (f) wherein each of the illuminating means respectively associated with the display areas included in each of said display sections has said flickering condition when the mode of operation to which the display section is allocated is selected by said mode selecting means, whereupon each of the illuminating means respectively associated with the display areas included in each of said display sections has said illuminating condition when the function to which the display area is selected by said function selecting means while each of the illuminating means associated with each of the other display areas included in the display section allocated to the mode of operation selected by said mode selecting means has said turned-off condition, and (g) wherein, when the mode of operation to which the display section including the first and second groups of display areas is allocated is selected by said mode selecting means, each of the illuminating means respectively associated with the display areas included in the display section has said flickering condition when the mode of operation to which the display section is allocated is selected by said mode selecting means whereupon, when one of the functions respectively indicated by the display areas of the first group is established, the illuminating means associated with the display area allocated to the selected function has said illuminating condition with each of the illuminating means for the other display areas brought into the turned-off condition and thereafter each of the illuminating means respectively associated with the display areas of the second group has said flickering condition until one of the functions to which these display areas is selected by said function selecting means.

46. A copying function selecting system, as set forth in claim 45, in which at least one of the display areas of the first group has no subsidiary display area in the second group of display areas, wherein none of the illuminating means respectively associated with the display areas of the second group is brought into the flickering condition when the function allocated to the display area of the first group which has no subsidiary display area in the second group of display areas is selected by said function selecting means.

47. A color display system for an image duplicating apparatus which includes a plurality of developing units respectively allocated to different print colors and which has a colored edited mode of operation, comprising (a) color indicating means for indicating the print color to which each of said plurality of developing units is allocated, and (b) display control means for controlling said color indicating means to indicate the print color to which one of said plurality of developing units is allocated when said colored edited mode of operation is selected.

48. An interactive control panel for an image duplicating apparatus, comprising (a) input switch means for selectively designating any of a plurality of groups of copying functions, and (b) input request means having an interactive mode of operation responsive to designation of any of said groups of copying conditions by said input switch means for requesting the user to select a first one of the copying functions included in the designated group of copying functions and allowing the user to successively designate the copying functions included in the designated group of copying functions, (c) said interactive mode of operation including a mode in which any of said copying functions is to be designated by a combination of said input switch means and additional input means, (d) said input request means being operative to request the user to select a second one of the copying functions included in the designated group of copying functions upon completion of the operation of said additional input means.

49. A magnification/reduction ratio selecting system for an image duplicating apparatus having a plurality of modes of operation including a magnification/reduction ratio select mode, comprising (a) image reproducing means having a plurality of magnification/reduction ratios for copying, (b) magnification/reduction ratio select mode selecting means for selecting said magnification/reduction ratio select mode out of said plurality of modes of operation, wherein said magnification/reduction ratio select mode is selected when said magnification/reduction ratio select mode selecting means is activated while the magnification/reduction ratio select mode is not established and the magnification/reduction ratio select mode is cancelled and, in turn, a predetermined magnification/reduction ratio is selected when said magnification/reduction ratio select mode selecting means is activated while the magnification/reduction ratio select mode is established.

50. An interactive control panel for an image duplicating apparatus having a plurality of modes of operation each including a plurality of copying functions, comprising (a) mode selecting means respectively allocated to said modes of operation, (b) function select means for stepwise selecting the copying functions included in each of said modes of operation so that the individual copying functions included in the mode of operation selected by said ode selecting means are stepwise selected by said function select means, wherein, when any of said mode selecting means is activated while any one of the copying functions included in the mode of operation selected by said mode selecting means is selected by said function select means, the function select means selects the function which is a single step prior to the function currently selected by said function select means.

* * * * *